US008302964B2

(12) United States Patent
Obuchi et al.

(10) Patent No.: US 8,302,964 B2
(45) Date of Patent: Nov. 6, 2012

(54) SHEET STACKING APPARATUS AND IMAGE FORMING APPARATUS

(75) Inventors: Yusuke Obuchi, Abiko (JP); Toshiki Momoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/274,327

(22) Filed: Nov. 19, 2008

(65) Prior Publication Data

US 2009/0127778 A1 May 21, 2009

(30) Foreign Application Priority Data

Nov. 20, 2007 (JP) ..... 2007-300599
Nov. 20, 2007 (JP) ..... 2007-300601

(51) Int. Cl.
*B65H 39/10* (2006.01)

(52) U.S. Cl. ..... 271/302; 271/298; 271/296; 271/299

(58) Field of Classification Search ..... 271/290, 271/296, 298, 299, 302, 303, 304
See application file for complete search history.

(56) References Cited

U.S. PATENT DOCUMENTS

| | | | | |
|---|---|---|---|---|
| 4,285,508 | A * | 8/1981 | Kaneko | 271/4.01 |
| 4,361,320 | A * | 11/1982 | Kikuchi et al. | 271/288 |
| 4,678,180 | A * | 7/1987 | Tamura et al. | 271/296 |
| 5,016,867 | A | 5/1991 | Kamath | |
| 5,087,026 | A * | 2/1992 | Wyer | 271/188 |
| 5,110,104 | A * | 5/1992 | Wakao et al. | 271/3.03 |
| 5,449,158 | A * | 9/1995 | Hirota et al. | 270/58.18 |
| 5,655,765 | A * | 8/1997 | Asami et al. | 271/185 |
| 5,743,518 | A * | 4/1998 | Takashimizu et al. | 271/4.1 |
| 2005/0006840 | A1 * | 1/2005 | Kusaka | 271/298 |

FOREIGN PATENT DOCUMENTS

| | | |
|---|---|---|
| JP | 02-018448 U | 2/1990 |
| JP | 05-124764 A | 5/1993 |
| JP | 09-227007 A | 9/1997 |
| JP | 9-255213 | 9/1997 |
| JP | 2005-47662 | 2/2005 |

* cited by examiner

*Primary Examiner* — Kaitlin Joerger
*Assistant Examiner* — Ernesto Suarez
(74) *Attorney, Agent, or Firm* — Canon USA Inc IP Division

(57) ABSTRACT

A stacker includes a sheet discharging portion constituted by a discharging belt and an extension roller that is in contact with the discharging belt. The position of the extension roller is changeable along the discharging belt. This means that, in the stacker, the position from which a sheet is discharged is changeable to a desired position in accordance with the sheet length by changing the position of the extension roller. Therefore, it is possible to stack sheets at a desired position on stacker trays, enabling the user to easily carry the stacked sheets from the stacker.

7 Claims, 22 Drawing Sheets

SHEET STACKING APPARATUS AND IMAGE FORMING APPARATUS

BACKGROUND OF THE INVENTION

1. Field of the Invention

The present invention relates to sheet stacking apparatuses and image forming apparatuses, and in particular to sheet stacking apparatuses in which sheets are selectively stacked onto a plurality of sheet stacking units.

2. Description of the Related Art

With the advancement in technology, recently developed image forming apparatuses form images on sheets at an increased image forming speed. With such an increase in the image forming speed, the speed of discharging sheets from the body of such an image forming apparatus is also increasing. For the purpose of aligning and stacking a large number of sheets that are discharged at a high speed, there are some image forming apparatuses that each include a large-capacity stacker apparatus, as a sheet stacking apparatus, disclosed in Japanese Patent Laid-Open No. 9-255213.

Referring to FIG. 24, a known sheet stacking apparatus 1 includes two stacking units, a first stacking unit 3A and a second stacking unit 3B, that can be individually raised and lowered while carrying sheets thereon. In the sheet stacking apparatus 1, if a redirecting tab 16 is turned upward (to a position shown in broken lines), each sheet that has been conveyed thereto through a first pair of sheet discharging rollers 15 can be stacked onto the first stacking unit 3A on the left side. As the number of sheets stacked on the first stacking unit 3A increases, the first stacking unit 3A is lowered. When a full-state detection sensor 19 detects that the first stacking unit 3A is full of sheets, the lowering of the first stacking unit 3A is stopped. Then, the redirecting tab 16 is turned downward (to a position shown in solid lines). Each sheet that has been conveyed thereto is guided to a second pair of sheet discharging rollers 18 on the right side and, through the second pair of sheet discharging rollers 18, is stacked onto the second stacking unit 3B. As the number of sheets stacked on the second stacking unit 3B increases, the second stacking unit 3B is also lowered. When a full-state detection sensor 20 detects that the second stacking unit 3B is full of sheets, the lowering of the second stacking unit 3B is stopped.

The length of each sheet that is stacked as described above is, at the maximum, half (L/2) the length (L) of each sheet that is stacked over the entirety of both the first and second stacking unit 3A and 3B.

In the known sheet stacking apparatus 1, the position at which a sheet is discharged is limited to fixed positions where the first and second pairs of sheet discharging rollers 15 and 18 are disposed. Therefore, when sheets of an intermediate length such as a length of (3/4)L covering the entirety of the first stacking unit 3A and about half of the second stacking unit 3B are stacked in the sheet stacking apparatus 1, each of the sheets needs to be discharged through the first pair of sheet discharging rollers 15.

This makes the sheet stacking apparatus 1 handle sheets of an intermediate length with reference to the first pair of sheet discharging rollers 15, so that all of such sheets are stacked over at least the entirety of the first stacking unit 3A. As a result, for example, the user cannot freely stack such sheets at a position from which the user desires to carry the sheets.

SUMMARY OF THE INVENTION

The present invention provides a sheet stacking apparatus whose sheet discharging position is movable so that sheets can be stacked at any desired position, and an image forming apparatus including such a sheet stacking apparatus.

According to a first aspect of the present invention, a sheet stacking apparatus includes a sheet discharging portion through which a sheet is discharged, and a plurality of sheet stacking units. The sheet that is discharged from the sheet discharging portion is selectively stacked on one of the plurality of sheet stacking units. The sheet discharging portion includes a discharging belt extending in a sheet discharging direction and configured to rotate and a movable rotary member configured to discharge the sheet by nipping the sheet in combination with the discharging belt. The position of the movable rotary member is changeable along the discharging belt depending on which of the plurality of sheet stacking units is selected.

According to a second aspect of the present invention, a sheet stacking apparatus includes a sheet discharging portion through which a sheet is discharged, and a sheet stacking unit onto which the sheet that is discharged from the sheet discharging portion is stacked. The sheet discharging portion includes a plurality of discharging rotary members arranged in a sheet discharging direction and a movable rotary member configured to discharge the sheet by nipping the sheet in combination with the discharging rotary members. The position of the movable rotary member is changeable to a position corresponding to one of the plurality of discharging rotary members.

The sheet stacking apparatus according to the first aspect of the present invention includes the sheet discharging portion, through which a sheet is discharged, constituted by the discharging belt and the movable rotary member that is in contact with the discharging belt, the position of the movable rotary member being changeable along the discharging belt. This means that, in the sheet stacking apparatus according to the first aspect of the present invention, the position from which a sheet is discharged can be changed in accordance with the sheet length by changing the position of the movable rotary member. Therefore, sheets can be stacked at a desired position on the sheet stacking units.

The sheet stacking apparatus according to the second aspect of the present invention includes the sheet discharging portion, through which a sheet is discharged, constituted by the discharging rotary members and the movable rotary member that is configured to be brought into contact with one of the discharging rotary members by being moved to a position corresponding to the one of the discharging rotary members. This means that, in the sheet stacking apparatus according to the second aspect of the present invention, the position from which a sheet is discharged can be changed in accordance with the sheet length by changing the position of the movable rotary member. Therefore, sheets can be stacked at a desired position on the sheet stacking unit.

Further features of the present invention will become apparent from the following description of exemplary embodiments with reference to the attached drawings.

DESCRIPTION OF THE EMBODIMENTS

Embodiments of a sheet stacking apparatus, as a stacker, and an image forming apparatus, which includes the stacker in its body, according to the present invention will now be described with reference to the drawings.

Image Forming Apparatus

Figure 1:
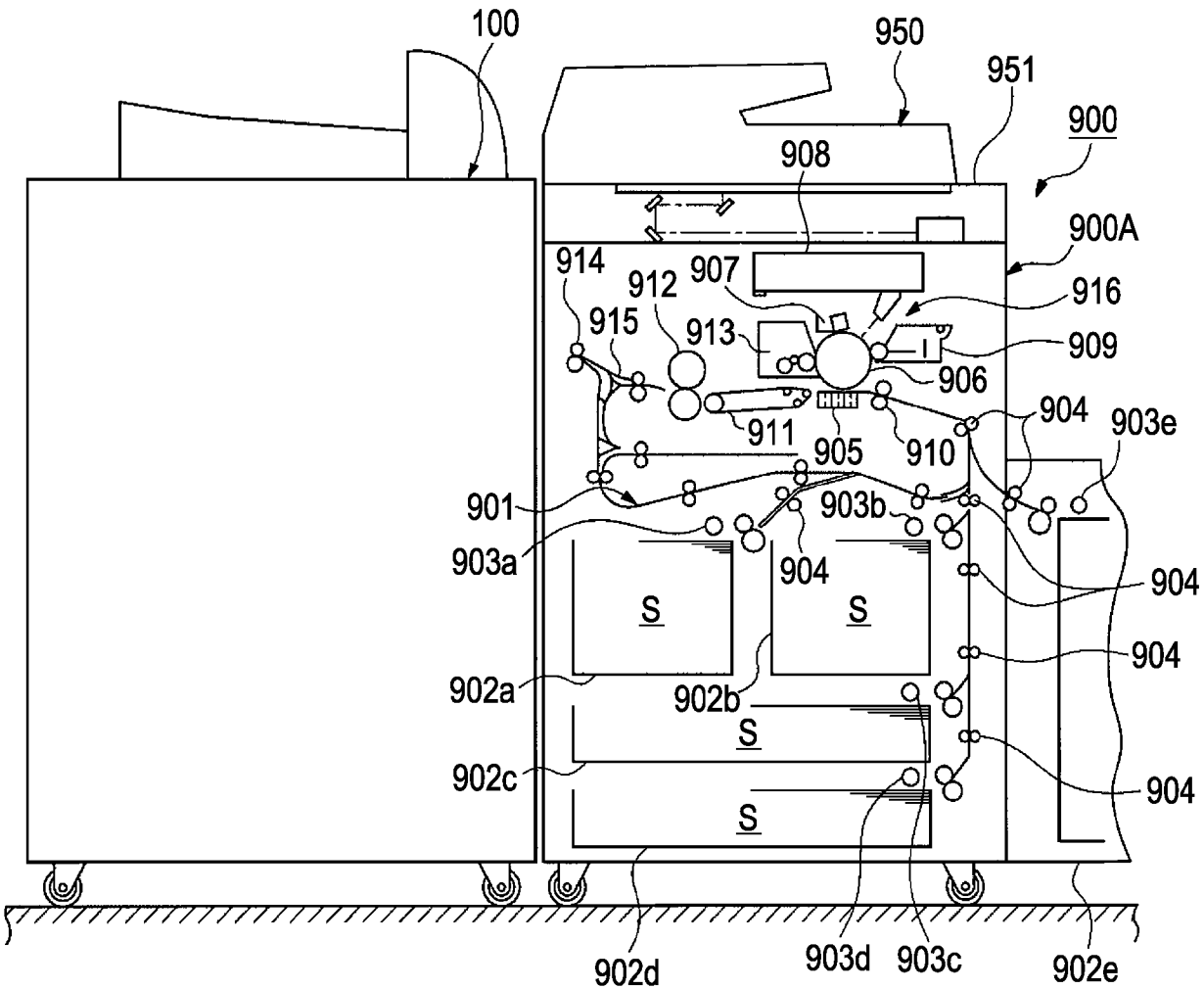
FIG. 1 is a cross-sectional view of an image forming apparatus according to a general embodiment of the present invention, taken in a sheet conveying direction.

FIG. 1 is a cross-sectional view of an image forming apparatus according to a general embodiment of the present invention, taken in a sheet conveying direction. An image forming apparatus 900 includes a body 900A in which images are formed and a stacker 100 serving as a sheet stacking apparatus in which sheets are stacked, thereby forming images on sheets. The stacker 100 may be incorporated in the body 900A. The body 900A includes an automatic document feeder 950 that automatically feeds a document to an image reader 951. The image reader 951 reads the document automatically fed from the automatic document feeder 950. The image reader 951 and the automatic document feeder 950 are not necessary. If the image forming apparatus 900 does not include the image reader 951, the image forming apparatus 900 forms an image on a sheet in accordance with sheet image information sent from an external facsimile or personal computer.

The operation of the body 900A of the image forming apparatus 900 will be described. Sheets S that are set in sheet feeding cassettes 902*a* to 902*e* are each conveyed by the corresponding one of sheet feeding rollers 903*a* to 903*e* through pairs of conveying rollers 904 to a pair of resist rollers 910. On the other hand, a photoconductive drum 906 after being subjected to primary charging performed by a primary charging unit 907 is subjected to exposure performed by an exposure unit 908 in accordance with digital document data sent from the image reader 951, whereby an electrostatic latent image is formed on the photoconductive drum 906. The electrostatic latent image is developed with toner by a developing unit 909, whereby a toner image is formed. The photoconductive drum 906, the primary charging unit 907, the developing unit 909, and so forth constitute an image forming portion 916.

The pair of resist rollers 910 conveys each sheet S into the nip between the photoconductive drum 906 and a transfer/detach charger 905 such that the leading end of the sheet S matches the leading end of the toner image on the photoconductive drum 906. A transfer bias is applied to the transfer/detach charger 905, whereby the toner image on the photoconductive drum 906 is transferred to the sheet S. The sheet S having the toner image transferred thereon is conveyed by a conveying belt 911 to a fusing unit 912, and is pressed with heat by the fusing unit 912, whereby the toner image is fixed. Toner and foreign substances remaining on the photoconductive drum 906 without being transferred to the sheet S are scraped off by a blade of a cleaner 913. The photoconductive drum 906 after being cleaned is then ready for a subsequent image forming operation. The sheet S having the toner image fixed thereon is further conveyed by a sheet discharging roller 914 to the stacker 100, or is directed by a redirecting member 915 that changes the sheet conveying direction to a sheet turner 901, where another image forming operation is performed.

Control Block Diagram

Figure 2:
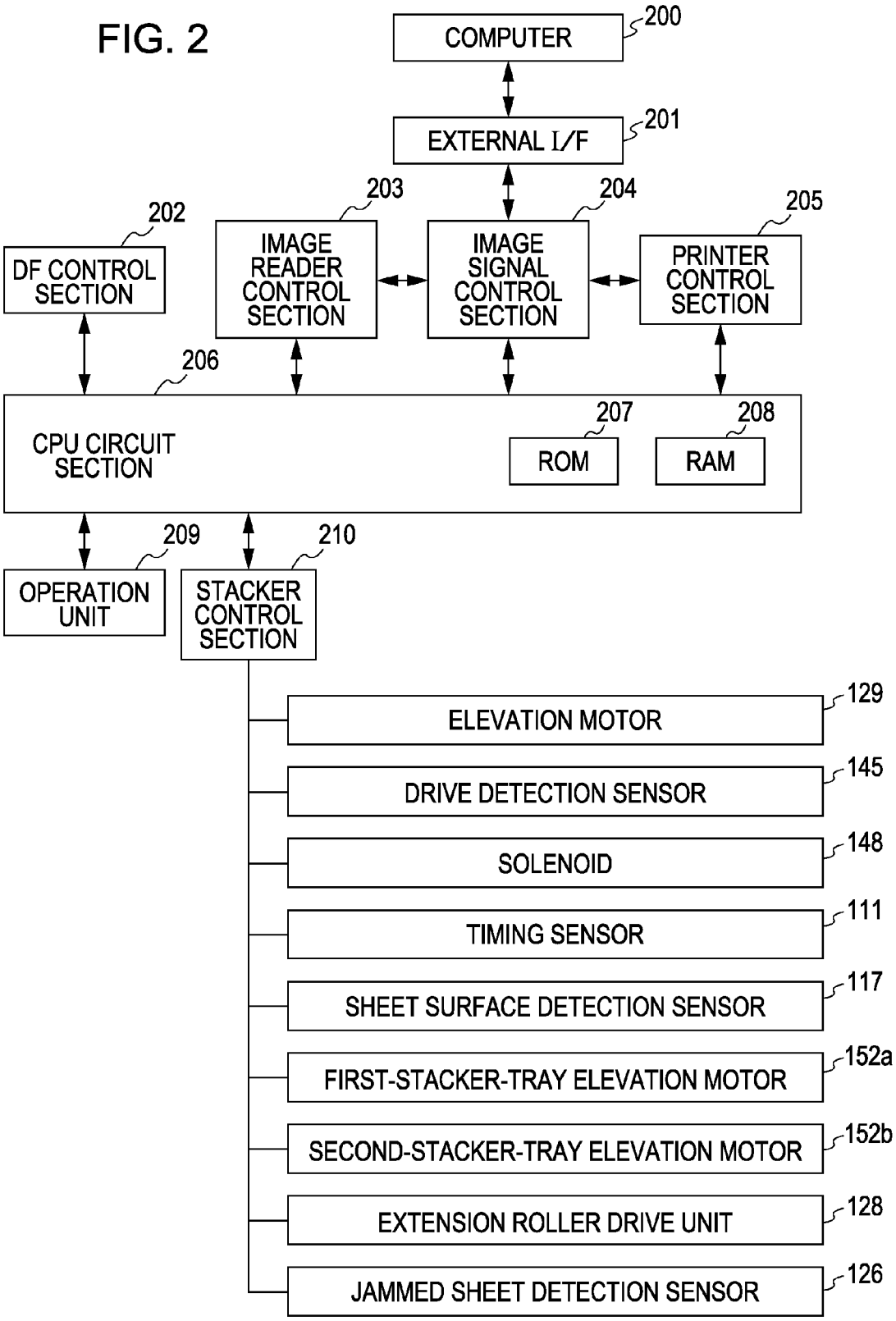
FIG. 2 is a diagram of a control block that controls the entirety of the image forming apparatus.

FIG. 2 is a control block diagram of a controller 960 that controls the entirety of the image forming apparatus 900.

The controller 960 includes a central-processing-unit (CPU) circuit portion 206. The CPU circuit portion 206 includes a CPU (not shown), a read-only memory (ROM) 207, and a random access memory (RAM) 208. The CPU circuit portion 206 generally controls a document feed (DF) control portion 202, an operation unit 209, an image reader control portion 203, an image signal control portion 204, a printer control portion 205, and a stacker control portion 210 in accordance with a control program stored in the ROM 207. The RAM 208 temporarily stores control data and is used as a workspace for arithmetic processing accompanied by the control operation.

The DF control portion 202 drives and controls the automatic document feeder 950 in accordance with an instruction given by the CPU circuit portion 206. The image reader control portion 203 drives and controls components such as a scanner unit 955 and an image sensor 954 included in the image reader 951, thereby transferring to the image signal control portion 204 an analog image signal that is output from the image sensor 954.

The image signal control portion 204 converts the analog image signal from the image sensor 954 into a digital signal, converts the digital signal into a video signal by performing appropriate processing thereto, and outputs the video signal to the printer control portion 205.

The image signal control portion 204 also receives a digital image signal from a computer 200 or from an external terminal through an external interface (I/F) 201, performs appropriate processing to the digital image signal, converts the digital image signal into a video signal, and outputs the video signal to the printer control portion 205. Such processings performed by the image signal control portion 204 are controlled by the CPU circuit portion 206.

The printer control portion 205 drives the exposure unit 908 via an exposure control portion (not shown) in accordance with the video signal that is input thereto. The operation unit 209 includes a plurality of keys with which various parameters relating to image formation are set, a display on which information indicating parameters that are set is displayed, and so forth. Further, the operation unit 209 outputs a key signal corresponding to each key operation to the CPU circuit portion 206 while displaying information obtained in accordance with the signal from the CPU circuit portion 206 on the display.

The stacker control portion 210 is provided in the stacker 100, and drives and controls the entirety of the stacker 100 on the basis of communication with the CPU circuit portion 206 provided in the body 900A of the image forming apparatus 900. The stacker control portion 210 is connected to an elevation motor 129, a first-stacker-tray elevation motor 152*a*, a second-stacker-tray elevation motor 152*b*, a drive detection sensor 145, a solenoid 148, and a timing sensor 111.

The stacker control portion 210 is also connected to a sheet surface detection sensor 117, an extension roller drive unit 128, a jammed sheet detection sensor 126, and so forth. The control operation performed by the stacker control portion 210 will be described separately below. The stacker control portion 210 may be integrally provided in the CPU circuit portion 206 included in the body 900A of the image forming apparatus 900 so that the stacker 100 can be controlled directly from the body 900A of the image forming apparatus 900.

When sheets of a small size such as A4 are discharged, the sheets can be selectively stacked onto either of a first stacker tray 112*a* and a second stacker tray 112*b*, whereby a large stacking capacity is realized. To stack sheets of a large size such as A3, the sheets are stacked over the entirety of both the first and second stacker trays 112*a* and 112*b*, whereby stacking of large-sized sheets is realized.

Figure 3:
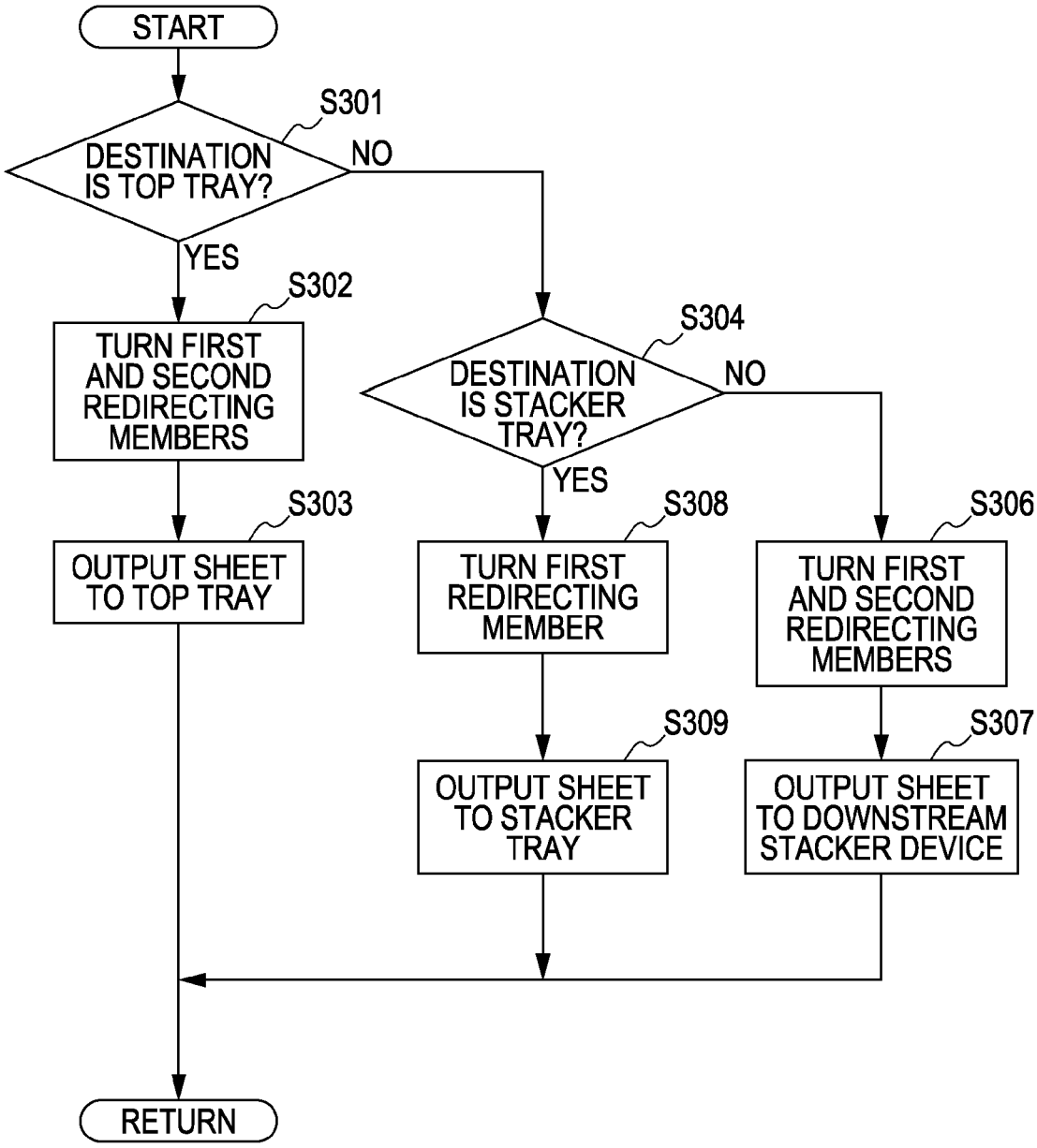
FIG. 3 is a flowchart for describing the general operation of a stacker, as a sheet stacking apparatus, according to a first embodiment of the present invention.

Basic Sheet Conveying and Stacking Operation Performed by Stacker of First Embodiment The basic operation of controlling sheet conveyance in the stacker 100 according to a first embodiment will be described with reference to the control block diagram shown in FIG. 2, a flowchart shown in FIG. 3, and diagrams shown in FIGS. 4 to 9.

After a sheet is discharged from the body 900A of the image forming apparatus 900, the sheet is conveyed into the stacker 100 by a pair of entrance rollers 101 of the stacker 100 to a first redirecting member 103. Prior to sheet conveyance, the stacker control portion 210 receives sheet information, such as the sheet size, the sheet type, and the sheet discharge destination, from the controller 960 (the CPU circuit portion 206) provided in the body 900A of the image forming apparatus 900.

Then, the stacker control portion 210 checks whether or not the sheet discharge destination indicated by the information sent from the controller 960 is a top tray 106 (step S301). If the sheet discharge destination is the top tray 106 (YES in step S301), the stacker control portion 210 turns the first redirecting member 103 and a second redirecting member 108 as required (step S302). Accordingly, the sheet is guided to a pair of conveying rollers 104 and subsequently discharged by a pair of discharging rollers 105 to the top tray 106 (step S303) and stacked thereon.

If the sheet discharge destination is not the top tray 106 (NO in step S301), the stacker control portion 210 further checks whether or not the sheet discharge destination is either of the first and second stacker trays 112*a* and 112*b* (step S304). If it is determined that the sheet discharge destination is neither of the first and second stacker trays 112*a* and 112*b* (NO in step S304), more specifically, if it is determined that the sheet discharge destination is a stacker apparatus (not shown) provided on the downstream of the stacker 100, the first redirecting member 103 and the second redirecting member 108 are turned as required (step S306).

As a result, the sheet that has been conveyed by the pair of entrance rollers 101 is further conveyed and guided by pairs of conveying rollers 107 and 102 to a pair of exit rollers 109, and is passed to the stacker apparatus (not shown) on the downstream (step S307).

If the sheet discharge destination is either of the first and second stacker trays 112*a* and 112*b* (YES in step S304), the first redirecting member 103 is turned as required (step S308). As a result, the sheet is guided by the first redirecting member 103, is conveyed to a pair of conveying rollers 110A, is discharged by a discharging belt 114 and the pair of conveying rollers 110A to either of the first and second stacker trays 112*a* and 112*b*, and is stacked thereon (step S309).

In the first embodiment, as described above, when sheets of a small size such as A4 are discharged, the sheets are stacked selectively onto either of the first and second stacker trays 112*a* and 112*b*.

Basic Small-Sized Sheet Conveying and Stacking Operation Performed by Stacker

The basic operation of controlling small-sized sheet conveyance in the stacker 100 will be described with reference to the control block diagram shown in FIG. 2, the diagrams shown in FIGS. 4 to 9, and a flowchart shown in FIG. 20. Small-sized sheets includes sheets of any size stackable on either of the first and second stacker trays 112*a* and 112*b*.

Figure 20:
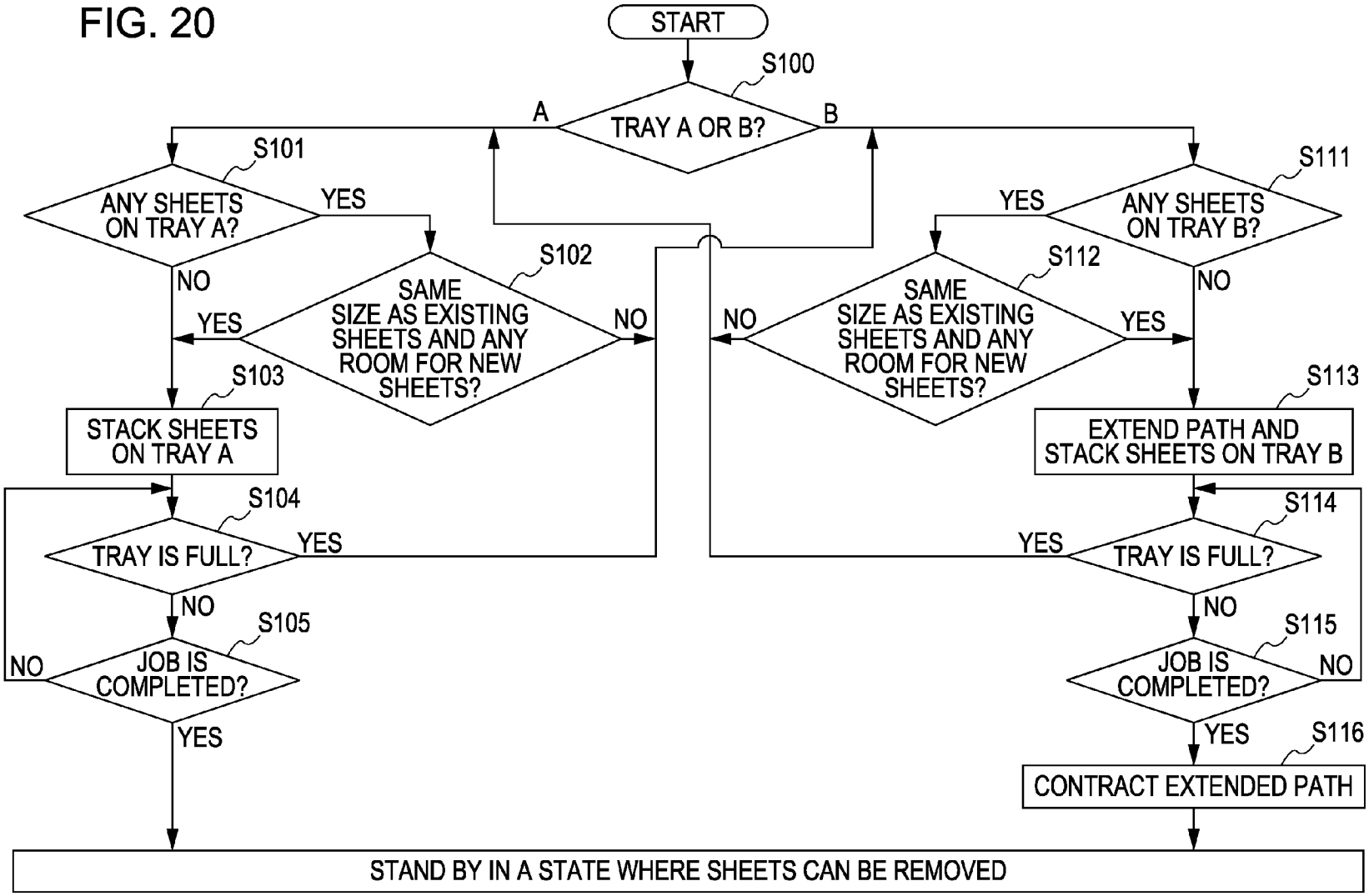
FIG. 20 is a flowchart for describing the operation of sheet stacking onto the first or second stacker tray.

FIG. 20 shows a flowchart of an operation in a case where small-sized sheets are stacked onto the first or second stacker tray 112*a* or 112*b*. In FIG. 20, the first stacker tray 112*a* and the second stacker tray 112*b* are simply denoted as a tray A and a tray B, respectively.

When a small-sized sheet is conveyed to the stacker 100, the stacker control portion 210 determines whether to stack the sheet onto the tray A or the tray B (step S100). If it is determined to stack the sheet onto the tray A (A in step S100), the stacker control portion 210 first checks whether or not there are any sheets on the tray A (step S101). If there are no sheets on the tray A (NO in step S101), the sheet is stacked onto the tray A (step S103).

If there are some sheets in the tray A (YES in step S101), the stacker control portion 210 checks whether or not the size of the sheet to be stacked is the same as that of the existing sheets on the tray A and whether or not the tray A still has room for new sheets (step S102). If the size of the sheet to be stacked is the same as that of the existing sheets on the tray A and if the tray A still has room for new sheets (YES in step S102), the sheet is stacked onto the tray A (step S103). If the tray A has no room for new sheets or if the size of the sheet to be stacked is not the same as that of the existing sheets on the tray A (NO in step S102), the stacker control portion 210 checks whether or not the sheet can be stacked onto the tray B. This case will be described separately below.

This operation of stacking sheets onto the tray A is continued until the tray A becomes full of sheets. If the tray A becomes full (YES in step S104), the subsequent sheet is to be stacked onto the other tray, the tray B. Even if the tray A is not yet full (NO in step S104), the job may be completed. In such a case (YES in step S105), the stacker 100 temporarily stops in a state where the stacked sheets can be removed.

If the tray A becomes full (YES in step S104) and therefore the subsequent sheet is to be stacked onto the tray B, the stacker control portion 210 first checks whether or not there are any sheets on the tray B (step S111). If there are no sheets on the tray B (NO in step S111), a reel film 123 is drawn out first so as to extend a sheet conveying path, and the subsequent sheet is then stacked onto the tray B (step S113). This extension is also performed when the stacker control portion 210 determines to stack the sheet onto the tray B (B in step S100).

If there are some sheets on the tray B (YES in step S101), the stacker control portion 210 checks whether or not the size of the sheet to be stacked is the same as that of the existing sheets on the tray B and whether or not the tray B still has room for new sheets (step S112). If the size of the sheet to be stacked is the same as that of the existing sheets on the tray B and if the tray B still has room for new sheets (YES in step S112), the sheet conveying path is extended first and the sheet is then stacked onto the tray B (step S113).

This operation of stacking sheets onto the tray B is continued until the tray B becomes full of sheets. If the tray B becomes full (YES in step S114), the subsequent sheet is to be stacked on the other tray, the tray A. Even if the tray B is not yet full (NO in step S114), the job may be completed. In such a case (YES in step S115), the extended path is first drawn in (step S116) and then the stacker 100 temporarily stops in a state where the stacked sheets can be removed.

According to FIG. 20, sheets are stacked onto the tray A and the tray B in that order. However, the order of the trays in stacking sheets is arbitrary. For example, in a case where sheets are stacked onto the tray B first and then onto the tray A, the same advantageous effect as described above can be obtained.

Stacker Trays

Figure 4:
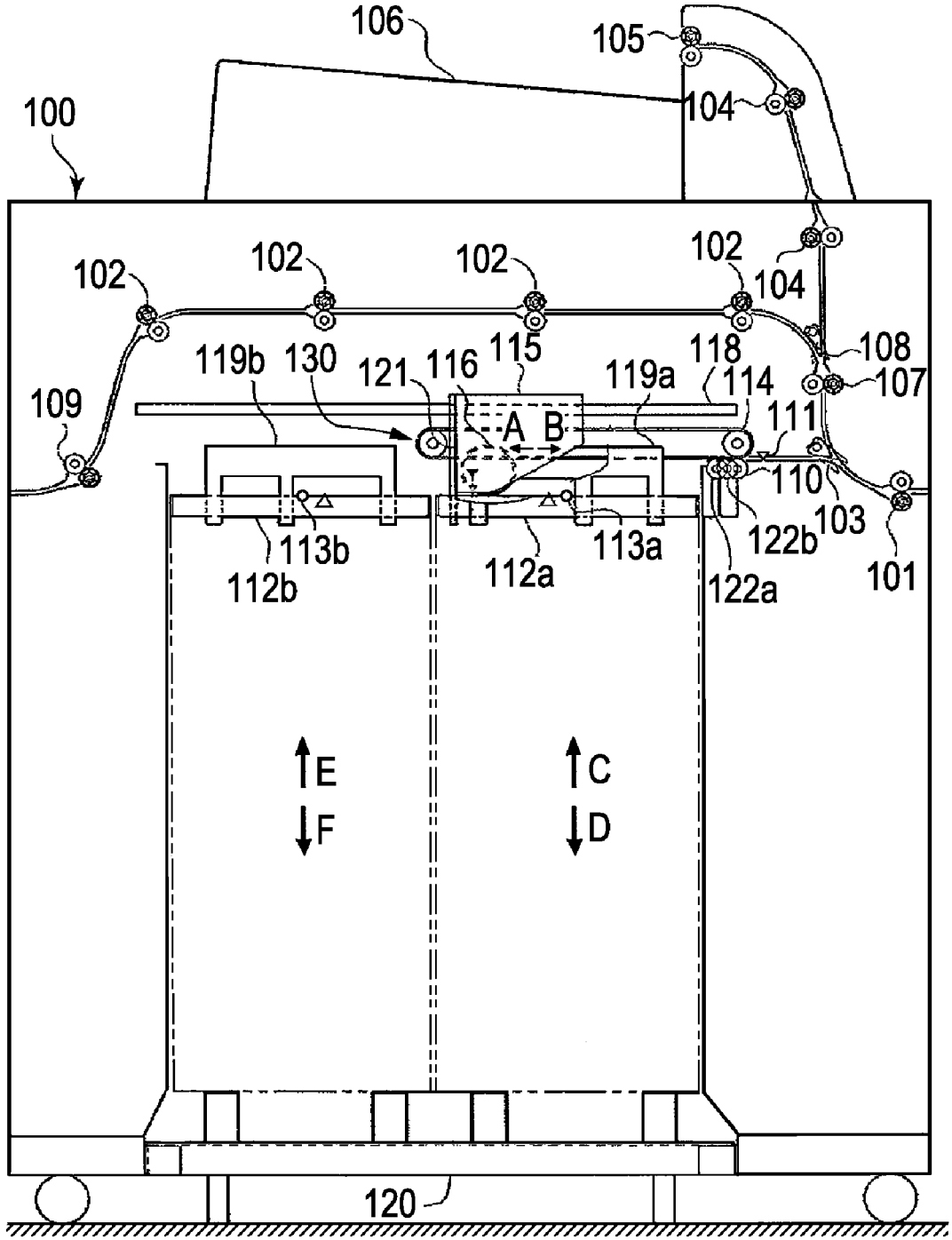
FIG. 4 shows a state where the stacker according to the first embodiment is ready for sheet stacking onto a first stacker tray.

To accommodate sheets that are discharged to the stacker 100, the first and second stacker trays 112*a* and 112*b*, as sheet stacking units, are disposed side by side in a sheet discharging direction and can be individually raised and lowered by drive units (not shown) in directions indicated by the arrows C and D and the arrows E and F shown in FIG. 4. The first and second stacker trays 112*a* and 112*b* stand by at their home positions while being detected by home position detection sensors 113*a* and 113*b*, respectively. A sheet guiding unit 115 provided on a slide shaft 118 is slidably moved by a drive unit (not shown) in directions indicated by the arrows A and B.

The sheet guiding unit 115 includes a knurled belt 116. The knurled belt 116 is rotated by a drive unit (not shown) clockwise, thereby drawing in each sheet to a leading end stopper 121. The sheet guiding unit 115 also includes the sheet surface detection sensor 117. The sheet surface detection sensor 117 is provided for the purpose of maintaining a constant interval between the knurled belt 116 and the top surface of the stack of sheets, thereby contributing the realization of stable guiding and stacking of sheets onto the first stacker tray 112*a* (or the second stacker tray 112*b*).

Operation of Stacking Sheets onto First Stacker Tray 112*a*

The operation of stacking sheets onto the first stacker tray 112*a*, the right one, will be described with reference to FIGS. 4 to 6.

When the first and second stacker trays 112*a* and 112*b* have no sheets thereon, the first and second stacker trays 112*a* and 112*b* both stand by at their home positions while being detected by the home position detection sensors 113*a* and 113*b*, respectively, waiting for new sheets to be stacked thereon. When the stacker control portion 210 receives from the CPU circuit portion 206 sheet information, which is input with the operation unit 209 to the CPU circuit portion 206, the stacker control portion 210 determines the position of the sheet guiding unit 115 in accordance with some of the contents of the sheet information, such as the sheet length and the stacker tray designation. If the sheet length information indicates a sheet length suitable for stacking onto the first stacker tray 112*a*, or if the stacker tray designation information indicates the first stacker tray 112*a*, the stacker control portion 210 causes the sheet guiding unit 115 to move to the downstream end of the first stacker tray 112*a* in the sheet discharging direction.

The stacker control portion 210 also causes an extension roller 122*a* to stand by at the upstream end of the discharging belt 114 while being in contact therewith. Hence, the upstream end of the discharging belt 114, i.e., the position at which the extension roller 122*a* is in contact with the discharging belt 114, is defined as a sheet discharging position of the discharging portion. Thus, the stacker 100 realizes sheet stacking onto the first stacker tray 112*a*, as desired by the user.

Figure 5:
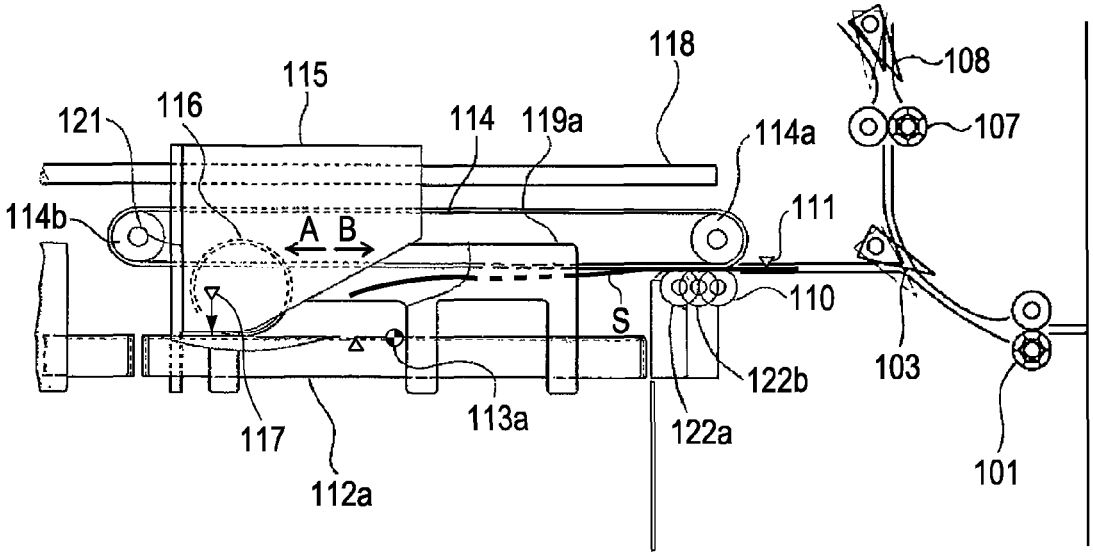
FIG. 5 shows a state where a sheet is going to be stacked onto the first stacker tray from the state shown in FIG. 4.
Figure 6:
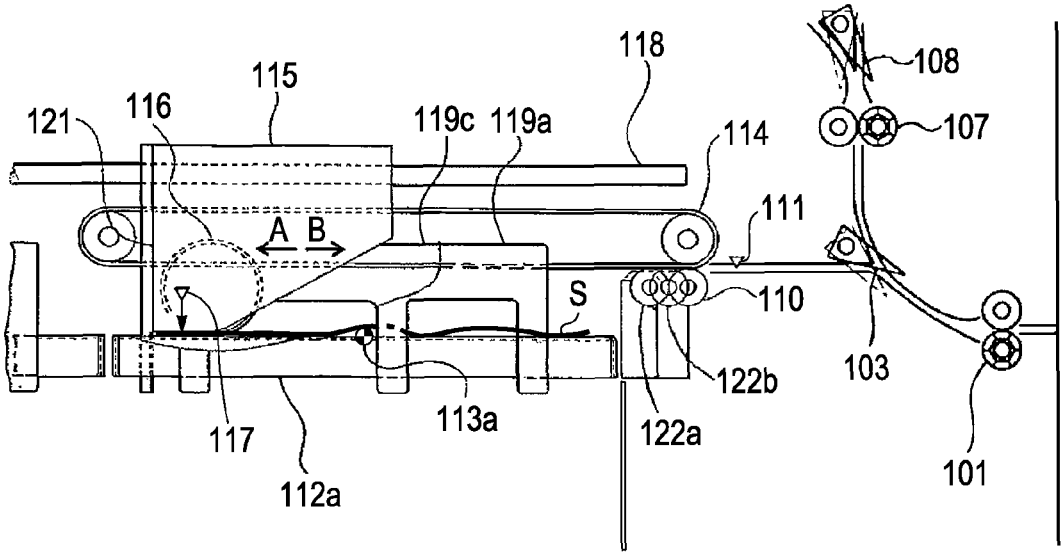
FIG. 6 shows a state where the sheet has been stacked onto the first stacker tray from the state shown in FIG. 5.

Referring to FIG. 5, a sheet S delivered from the body 900A of the image forming apparatus 900 (see FIG. 1) is conveyed through the pair of entrance rollers 101 and guided by the first redirecting member 103 to the discharging belt 114. The discharging belt 114, a driven roller 110, and the extension rollers 122*a* and 122*b* in combination nip the sheet S and rotate so as to convey the sheet S toward the sheet guiding unit 115 at a sheet conveying speed the same as that produced by the pair of entrance rollers 101.

After the timing sensor 111 detects the passage of the leading end of the sheet S, the stacker control portion 210 reduces the sheet conveying speed produced by the discharging belt 114 at least immediately before the trailing end of the sheet S comes out of the nip between the discharging belt 114 and the extension roller 122*a*. Since the sheet conveying speed is reduced, the sheet S is stably delivered to the knurled belt 116 and, as shown in FIG. 6, is assuredly made to knock against the leading end stopper 121 with the aid of the knurled belt 116. As a result, tilting of the sheet S is corrected, and the sheet S is stacked onto the first stacker tray 112*a* in a state where the leading end of the sheet S is aligned with improved accuracy.

Subsequently, a pair of aligning plates 119*a* and 119*c* approach each other in a direction perpendicular to the sheet discharging direction so that displacement in the direction perpendicular to the sheet discharging direction can be corrected from both sides thereof. That is, the pair of aligning plates 119*a* and 119*c* align the sheet S in the width direction. In FIG. 6, the aligning plate 119*a* is disposed on the front side, and the aligning plate 119*c* is disposed on the rear side. After the sheet S is discharged from the discharging belt 114, the discharging belt 114 is caused to increase the speed of its rotation, while standing by for a subsequent sheet, so as to convey the subsequent sheet at a sheet conveying speed the same as that produced by the pair of entrance rollers 101.

By repeating the above-described operation, the stacker 100 sequentially stacks sheets S onto the first stacker tray 112*a* with high alignment accuracy. The sheet surface detection sensor 117 continuously monitors the top surface of the stack of sheets. The stacker control portion 210 controls lowering of the first stacker tray 112*a* on the basis of the detection of the top surface of the stack of sheets performed by the sheet surface detection sensor 117, thereby maintaining a constant interval between the knurled belt 116 of the sheet guiding unit 115 and the top surface of the stack of sheets. Thus, a force with which the knurled belt 116 draws in a sheet is maintained at a constant level, and the leading ends of sheets can be aligned with improved accuracy.

The number of sheets stacked on the first stacker tray 112*a* is counted by the stacker control portion 210 as the number of sheets detected by the timing sensor 111. When the number of sheets reaches a predetermined value, the stacker control portion 210 determines that the first stacker tray 112*a* is full of sheets. This determination may be made by using a sensor (not shown) configured to detect lowering of the first stacker tray 112*a*, onto which sheets are sequentially stacked, to a predetermined position.

Figure 17:
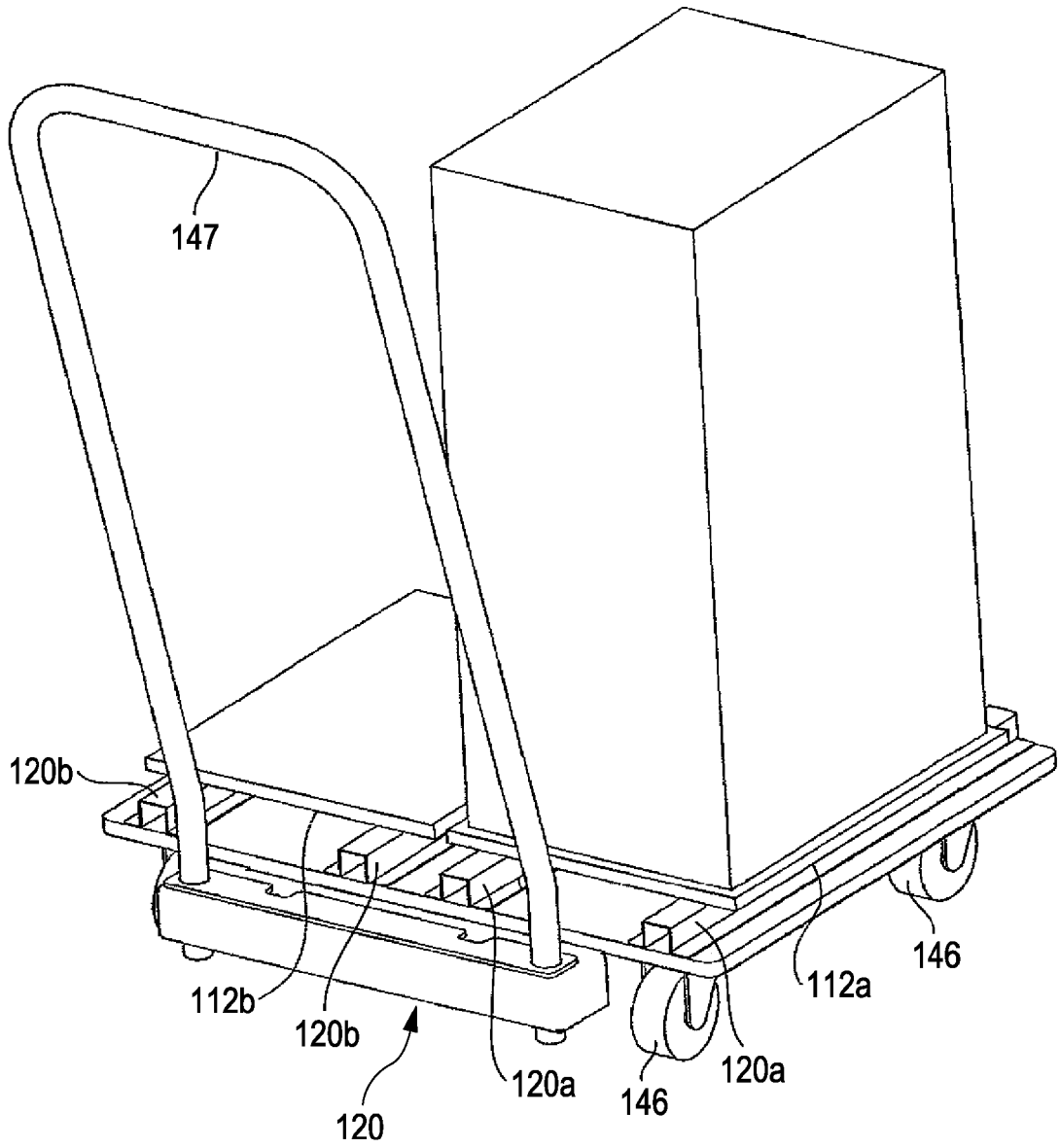
FIG. 17 shows a case where a stack of sheets on the first stacker tray is carried with a dolly.

When the first stacker tray 112*a* becomes full of sheets, the first stacker tray 112*a* is automatically lowered further to a position on a dolly 120, shown in FIG. 17, at which the first stacker tray 112*a* is secured with a securing member (not shown), thereby being ready to be carried outside. The manner in which the sheets are carried with the dolly 120 will be described separately below. The first stacker tray 112*a* is raised and lowered while being supported by a fork (not shown) that is movable up and down. As fingers of the fork are inserted into corresponding ones of a pair of convex rails 120*a* provided on the dolly 120, the first stacker tray 112*a* carrying the sheets thereon is placed on the convex rails 120*a*.

Operation of Stacking Sheets onto Second Stacker Tray 112*b*

The operation of stacking sheets onto the second stacker tray 112*b*, the left one, will be described with reference to FIGS. 7 to 10.

When the stacker control portion 210 receives from the CPU circuit portion 206 sheet information, which is input with the operation unit 209 to the CPU circuit portion 206, the stacker control portion 210 determines the position of the sheet guiding unit 115 in accordance with some of the contents of the sheet information, such as the sheet length and the stacker tray designation. If the sheet length information indicates a sheet length suitable for stacking onto the second stacker tray 112*b*, or if the stacker tray designation information indicates the second stacker tray 112*b*, the stacker control portion 210 causes the first and second stacker trays 112*a* and 112*b* to be lowered by respective drive units (not shown) to positions at which the first and second stacker trays 112*a* and 112*b* allow the sheet guiding unit 115 to move in the arrow-A direction. Then, the stacker control portion 210 causes the sheet guiding unit 115 to be moved by a drive unit (not shown) in the arrow-A direction to the downstream end of the second stacker tray 112*b* in the sheet discharging direction. Subsequently, the second stacker tray 112*b* is raised to a position at which it is detectable by the home position detection sensor 113*b*.

Figure 7:
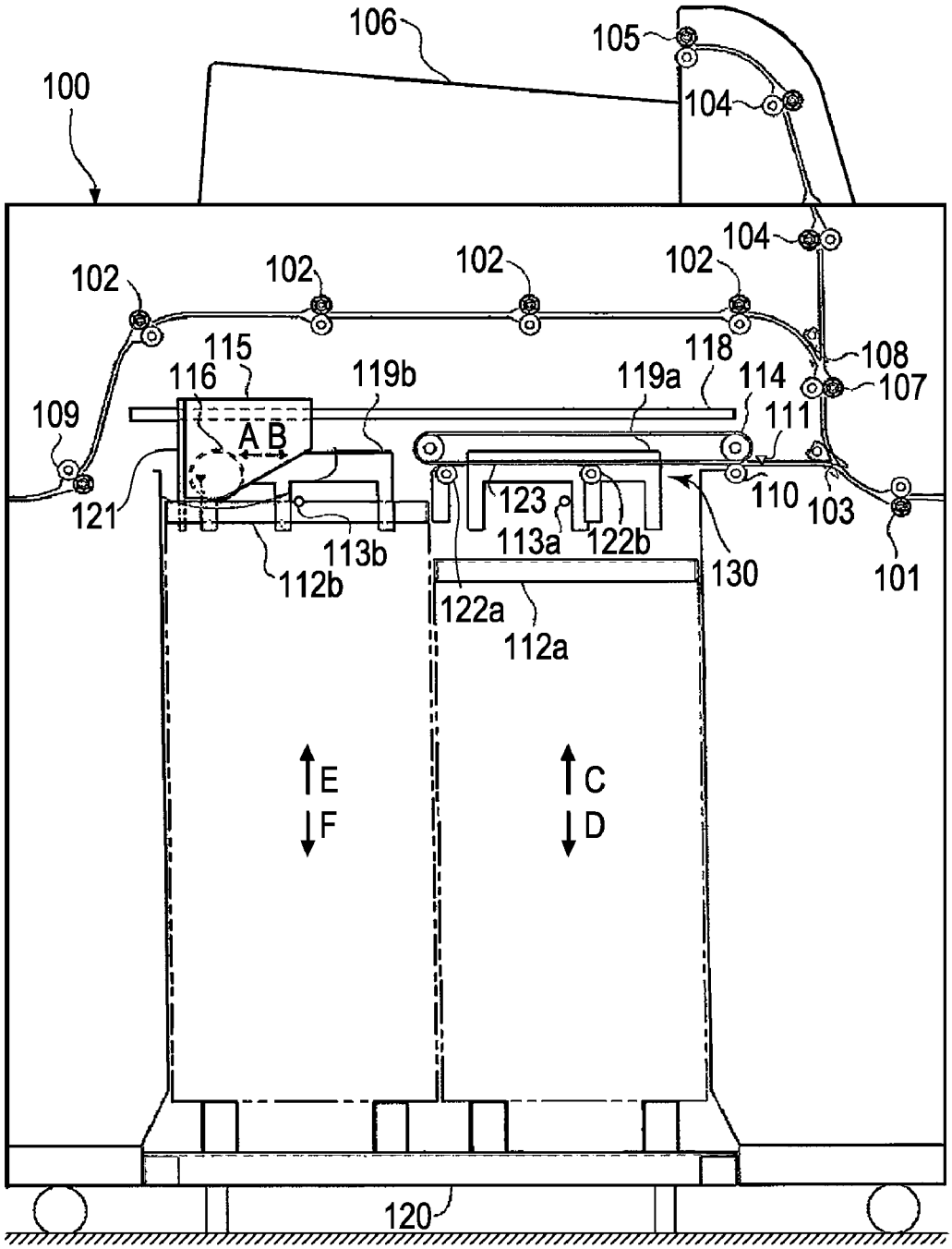
FIG. 7 shows a state where the stacker according to the first embodiment is ready for sheet stacking onto a second stacker tray.

Further, referring to FIG. 7, the extension roller 122*a* provided in an extended path 130 is moved to the downstream end of the discharging belt 114, and the extension roller 122*b* is moved to a mid position of the discharging belt 114. Now, the extended path 130 provided with the extension rollers 122*a* and 122*b* will be described with reference to FIG. 10.

Guide shafts 131 are provided in a pair at fixed positions in such a manner as to extend in the sheet discharging direction. The guide shafts 131 each have sliders 132 and 133 movable therealong. The sliders 132 are connected to each other with a roller support shaft 134. Likewise, the sliders 133 are connected to each other with a roller support shaft 135. The roller support shafts 134 and 135 are unrotatable with respect to the sliders 132 and 133, respectively. The roller support shaft 134 is provided with the extension roller 122*a* (provided in a plurality in FIG. 10) rotatable thereon. The roller support shaft 135 is provided with the extension roller 122*b* (provided in a plurality in FIG. 10) rotatable thereon.

A film shaft 136 is provided at a fixed position on the upstream with respect to the roller support shaft 135 in the sheet discharging direction. The roller support shafts 134 and 135 and the film shaft 136 are disposed parallel to each other. The film shaft 136 is provided with a reel 137 (provided in a plurality in FIG. 10) with which the reel film 123 is drawn in. The leading end of the reel film 123 is attached to a film draw-out member 138 (provided in a plurality in FIG. 10) provided on the roller support shaft 134. Alternatives to the reel film 123 include an extendable/contractible bellows member, and a member constituted by a plurality of narrow strip-like plates connected with each other in such a manner as to be extendable and contractible.

The sliders 132 are connected to a belt 139 that is rotated by a motor (not shown). One slider 132 and the corresponding slider 133 are connected to each other with a tension spring 140 provided therebetween. The corresponding slider 133 is regulated by a fixed stopper 141 so as to be movable within about half the movable range of the one slider 132. The stopper 141 is fixed at a position at which it does not come into contact with the one slider 132 while the one slider 132 is moving.

In the extended path 130 included in the above-described configuration, when the belt 139 is rotated in an arrow-G direction, the one slider 132 also slides in the arrow-G direction accompanying the rotation of the belt 139. Accordingly, the roller support shaft 134, the extension roller 122*a*, the film draw-out member 138, and the other slider 132 on the left side in FIG. 10 also move in the arrow-G direction while the film draw-out member 138 draws out the reel film 123 from the reel 137.

When the one slider 132 moves in the arrow-G direction, the corresponding slider 133 is pulled by the tension spring 140 and also moves in the arrow-G direction. When the corresponding slider 133 moves, the roller support shaft 135, the extension roller 122*b*, and the other slider 133 on the left side in FIG. 10 also move in the arrow-G direction.

Referring to FIG. 7, when the extension roller 122*a* reaches the downstream end of the first stacker tray 112*a* and the discharging belt 114 in the sheet discharging direction, the belt 139 stops rotating. In this state, the corresponding slider 133 is pressed against and is stopped by the stopper 141 at a position around the center of the first stacker tray 112*a*, and the length of the tension spring 140 that is stretched is shorter than a length over which plastic deformation of the tension spring 140 occurs. The extension rollers 122*a* and 122*b* are always in contact with the discharging belt 114 directly or indirectly through a sheet, thereby being rotated in such a manner as to follow the rotation of the discharging belt 114.

On the other hand, the reel film 123 is drawn out, below the discharging belt 114, to a position to which the extension roller 122*a* has been moved. Thus, the sheet to be discharged onto the second stacker tray 112*b* is supported by the reel film 123 while being prevented by the discharging belt 114, provided thereabove, from becoming slack.

In FIG. 7, with the movement of the extension roller 122*a* to the downstream end of the discharging belt 114, the sheet discharging position is moved to the downstream end of the discharging belt 114. Therefore, the sheet can be stacked onto the second stacker tray 112*b*, as desired by the user. In short, FIG. 7 shows a state where the stacker 100 is ready for sheet stacking onto the second stacker tray 112*b*, with the extended path 130 being extended to the upstream end of the second stacker tray 112*b*.

Figure 10:
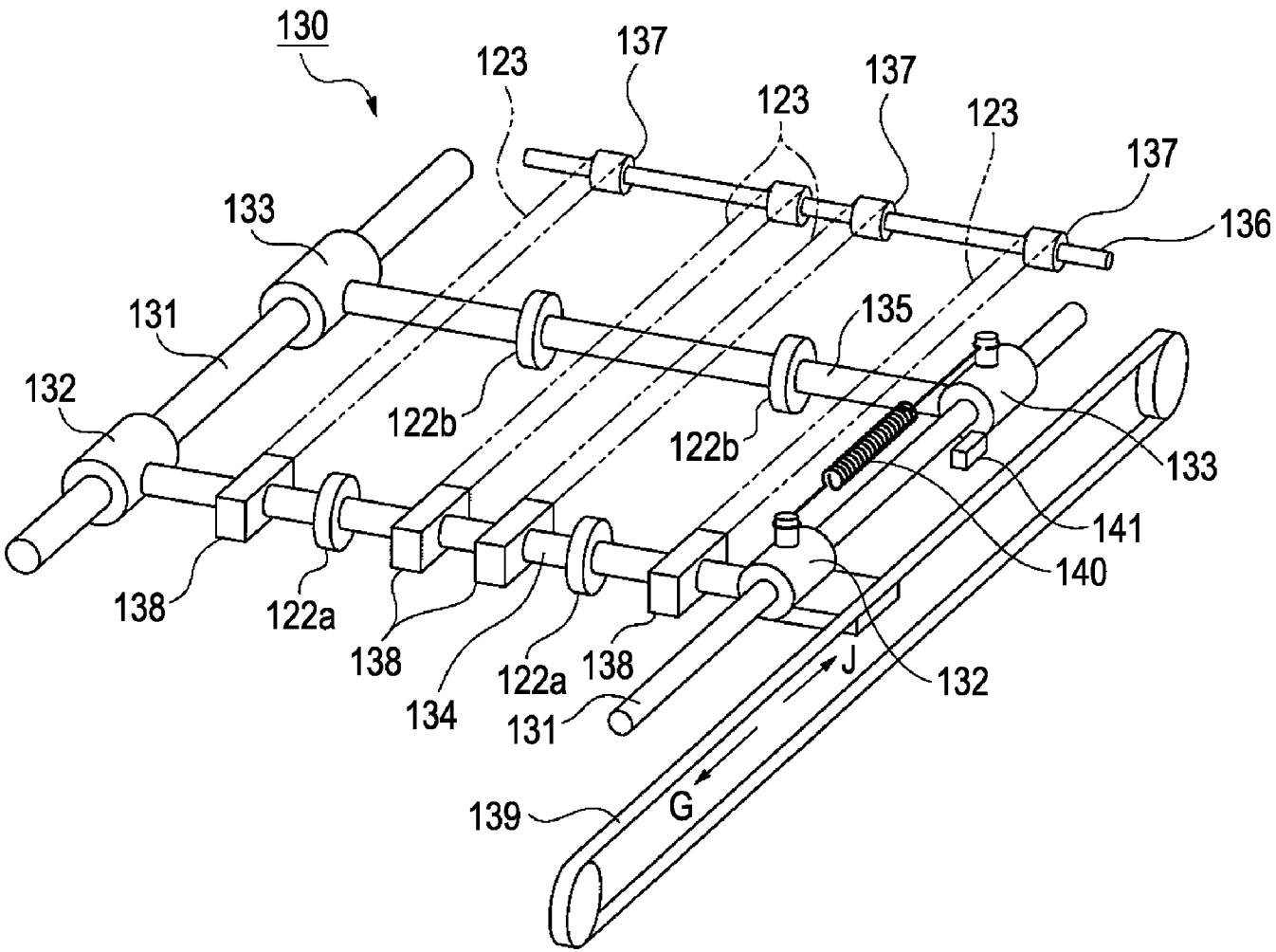
FIG. 10 is a schematic perspective view of an extended path.

Referring to FIG. 10, when the belt 139 rotates in an arrow-J direction, movable components including the extension rollers 122*a* and 122*b* also move in the arrow-J direction. When in the standby state, the extension rollers 122*a* and 122*b* are positioned close to and on the downstream of the driven roller 110, as shown in FIG. 4. In FIG. 4, the driven roller 110 and the extension rollers 122*a* and 122*b* appear to overlap each other because the driven roller 110 and the extension rollers 122*a* and 122*b* are arranged at positions staggered along the respective shafts.

Figure 8:
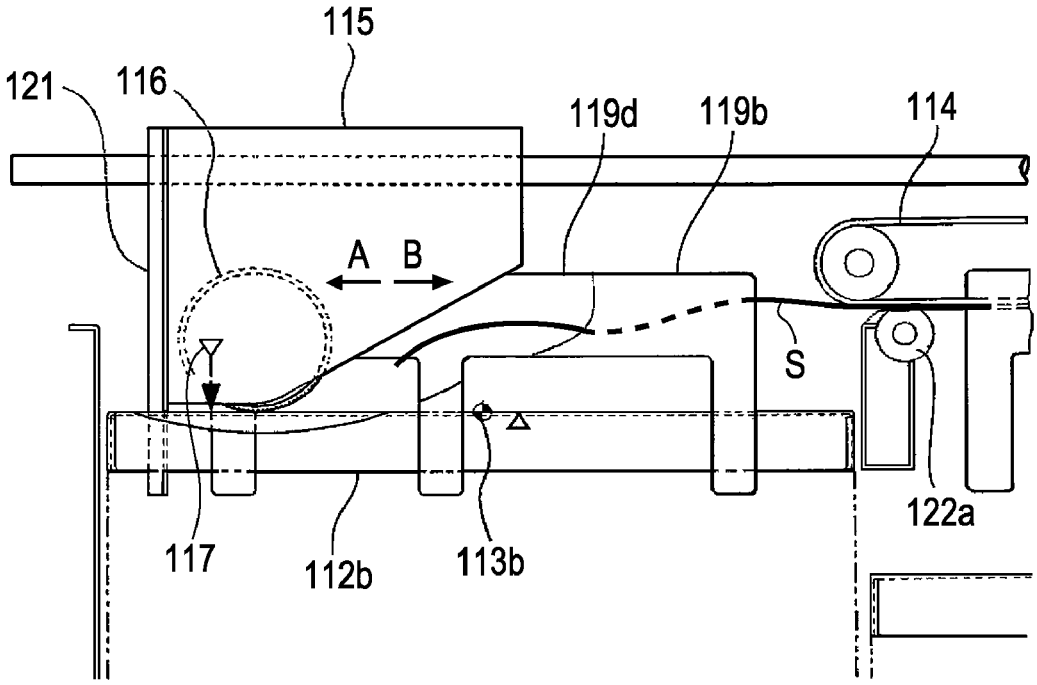
FIG. 8 shows a state where a sheet is going to be stacked onto the second stacker tray from the state shown in FIG. 7.

Referring to FIG. 8, the sheet S that has been conveyed from the body 900A of the image forming apparatus 900 to the discharging belt 114 is further conveyed by the discharging belt 114 and the extension rollers 122*a* and 122*b* to the second stacker tray 112*b* while being supported by the reel film 123.

The same as in the case of sheet stacking onto the first stacker tray 112*a*, the stacker control portion 210 reduces the sheet conveying speed produced by the discharging belt 114 so that the sheet S is stably delivered to the knurled belt 116 and is assuredly made to knock against the leading end stopper 121. As a result, tilting of the sheet S is corrected, whereby the leading end of the sheet S can be aligned with improved accuracy.

Figure 9:
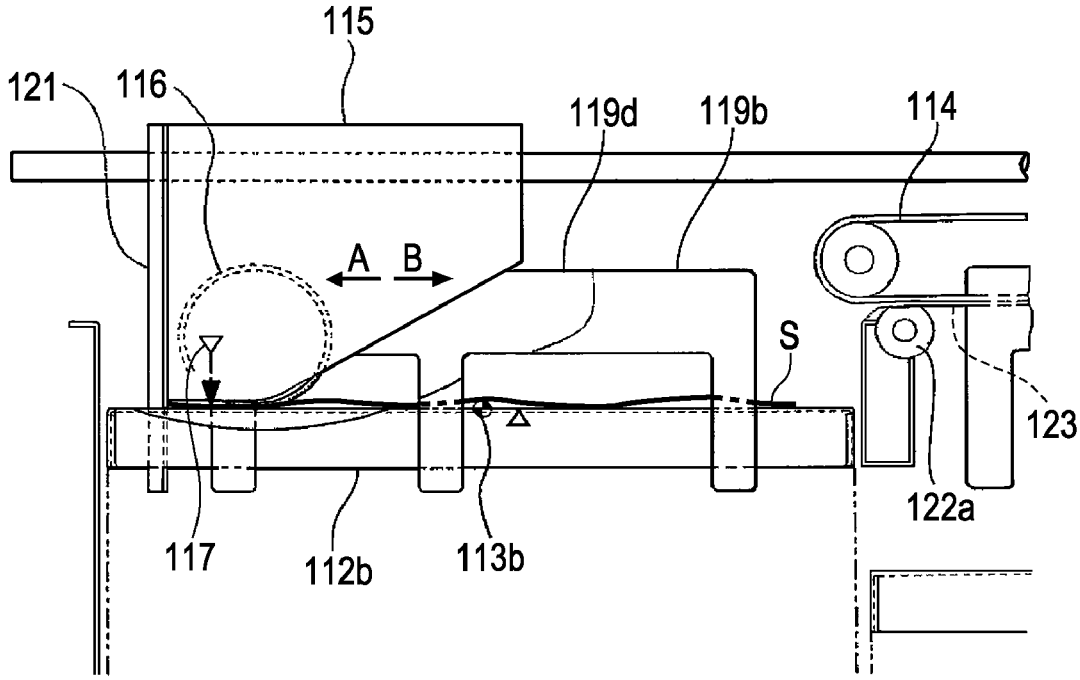
FIG. 9 shows a state where the sheet has been stacked onto the second stacker tray from the state shown in FIG. 8.

Subsequently, a pair of aligning plates 119*b* and 119*d* align the sheet S in the width direction, as in the case of the aligning plates 119*a* and 119*c*. In FIG. 9, the aligning plate 119*b* is disposed on the front side, and the aligning plate 119*d* is disposed on the rear side. After the sheet S is discharged from the discharging belt 114, the discharging belt 114 is caused to increase the speed of its rotation, while standing by for a subsequent sheet, so as to convey the subsequent sheet at a sheet conveying speed the same as that produced by the pair of entrance rollers 101.

By repeating the above-described operation, the stacker 100 sequentially stacks sheets S onto the second stacker tray 112*b* with high alignment accuracy. The stacker control portion 210 controls lowering of the second stacker tray 112*b* on the basis of the detection of the top surface of the stack of sheets performed by the sheet surface detection sensor 117, thereby maintaining a constant interval between the knurled belt 116 of the sheet guiding unit 115 and the top surface of the stack of sheets. Thus, a force with which the knurled belt 116 draws in a sheet is maintained at a constant level, and the leading ends of sheets can be aligned with improved accuracy.

When the second stacker tray 112*b* is detected to be full of sheets as in the case of sheet stacking onto the first stacker tray 112*a*, the second stacker tray 112*b* carrying the stacked sheets thereon is placed over a pair of convex rails 120*b* of the dolly 120 and is secured thereon.

Operation of Stacking Sheets over Entirety of First and Second Stacker Trays 112*a* and 112*b*

This operation is performed in a state where the extension rollers 122*a* and 122*b* are positioned at the upstream end of the discharging belt 114 and the sheet guiding unit 115 is positioned at the downstream end of the second stacker tray 112*b*. In this state, sheets are stacked as in the case of sheet stacking onto the first stacker tray 112*a*.

Operation of Stacking Sheets over Entirety of Second Stacker Tray 112*b* and Part of First Stacker Tray 112*a*

Figure 11:
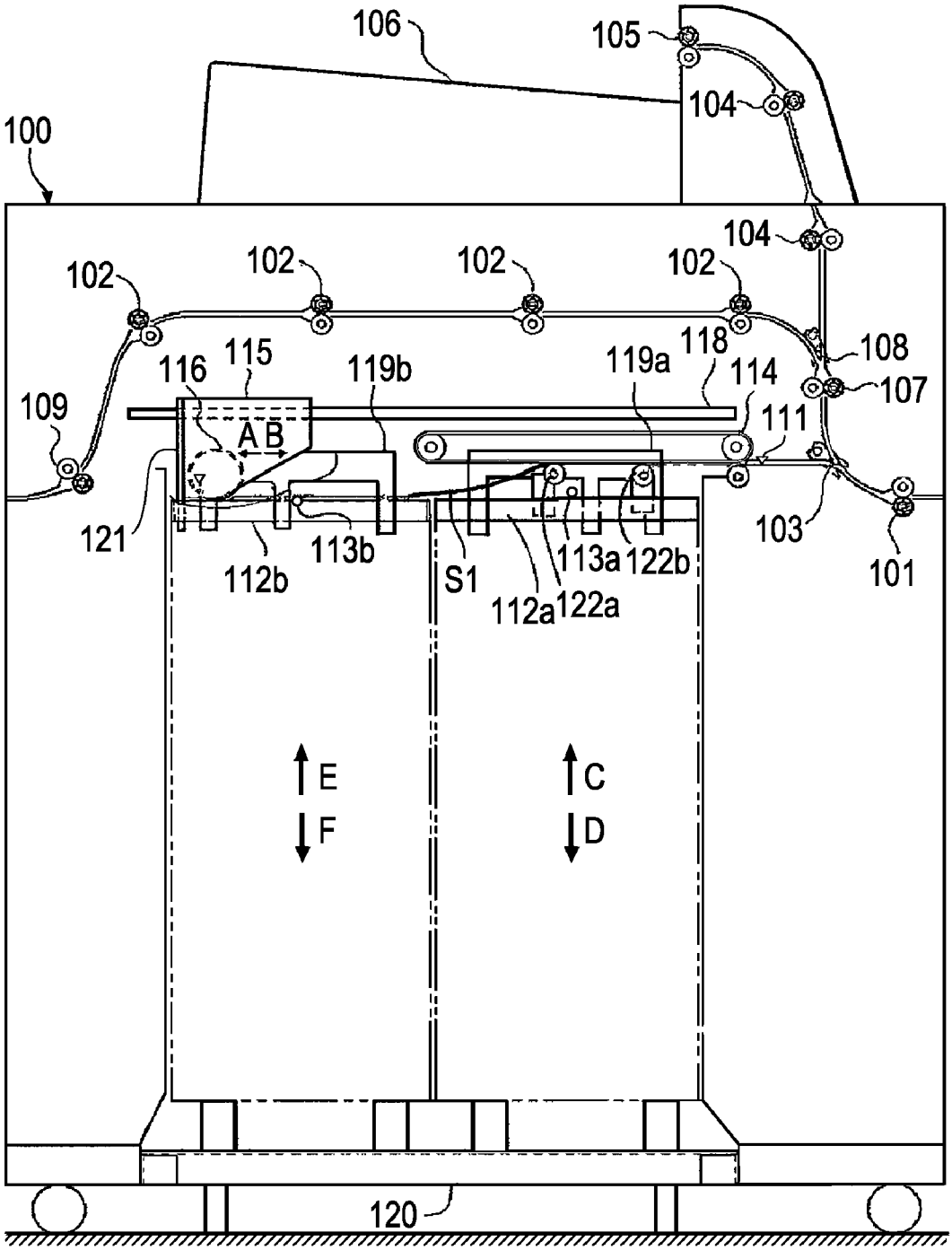
FIG. 11 shows a state where a sheet is going to be stacked over the entirety of the second stacker tray and part of the first stacker tray.

Referring to FIG. 11, an operation of stacking a sheet S1 over the entirety of the second stacker tray 112*b* and part of the first stacker tray 112*a* will be described.

When the stacker control portion 210 receives from the CPU circuit portion 206 sheet information, which is input with the operation unit 209 to the CPU circuit portion 206, the stacker control portion 210 determines the position of the sheet guiding unit 115 in accordance with some of the contents of the sheet information, such as the sheet length and the stacker tray designation.

If the sheet information indicates that the sheet S1 is to be stacked over the entirety of the second stacker tray 112*b* and part of the first stacker tray 112*a*, the stacker control portion 210 causes the sheet guiding unit 115 to stand by at the downstream end of the second stacker tray 112*b* and the extension roller 122*a* to stand by at a position matching the length of the sheet S1. The extension roller 122*a* is positioned above a halfway point of the first stacker tray 112*a*. In this case, a halfway point of the discharging belt 114 at which the extension roller 122*a* is in contact with the discharging belt 114 is defined as the sheet discharging position of the discharging portion. Thus, the sheet S can be stacked over the entirety of the second stacker tray 112*b* and part of the first stacker tray 112*a*, as desired by the user.

Further, the stacker control portion 210 causes the first and second stacker trays 112*a* and 112*b* to stand by at their home positions while causing the home position detection sensors 113*a* and 113*b* to detect the first and second stacker trays 112*a* and 112*b*.

As shown in FIG. 11, the sheet S1 delivered from the body 900A of the image forming apparatus 900 (FIG. 1) is conveyed through the pair of entrance rollers 101 and is guided by the first redirecting member 103 to the discharging belt 114. The discharging belt 114, the driven roller 110, and the extension rollers 122*a* and 122*b* in combination nip the sheet S1 and rotate so as to convey the sheet S1 toward the sheet guiding unit 115 at a sheet conveying speed the same as that produced by the pair of entrance rollers 101.

The same as in the case of sheet stacking onto the first stacker tray 112*a*, the stacker control portion 210 reduces the sheet conveying speed produced by the discharging belt 114 so that the sheet is stably delivered to the knurled belt 116 and is assuredly made to knock against the leading end stopper 121. As a result, tilting of the sheet S is corrected, whereby the leading end of the sheet S is aligned with improved accuracy.

Subsequently, the pair of aligning plates 119*a* and 119*c* and the pair of aligning plates 119*b* and 119*d* align the sheet S in the width direction. After the sheet S is discharged from the discharging belt 114, the discharging belt 114 is caused to increase the speed of its rotation, while standing by for a subsequent sheet, so as to convey the subsequent sheet at a sheet conveying speed the same as that produced by the pair of entrance rollers 101.

By repeating the above-described operation, the stacker 100 sequentially stacks sheets S over the first and second stacker trays 112*a* and 112*b* with high alignment accuracy. The sheet surface detection sensor 117 continuously monitors the top surface of the stack of sheets. The stacker control portion 210 controls lowering of the first and second stacker trays 112*a* and 112*b* on the basis of the detection of the top surface of the stack of sheets performed by the sheet surface detection sensor 117, thereby maintaining a constant interval between the knurled belt 116 of the sheet guiding unit 115 and the top surface of the stack of sheets. Thus, a force with which the knurled belt 116 draws in a sheet is maintained at a constant level, and the leading ends of sheets can be aligned with improved accuracy.

When the first and second stacker trays 112*a* and 112*b* become full of sheets, the first and second stacker trays 112*a* and 112*b* carrying the sheets thereon are placed on the dolly 120 and are ready to be carried outside.

Operation of Stacking Sheets over Entirety of First Stacker Tray 112*a* and Part of Second Stacker Tray 112*b*

Figure 12:
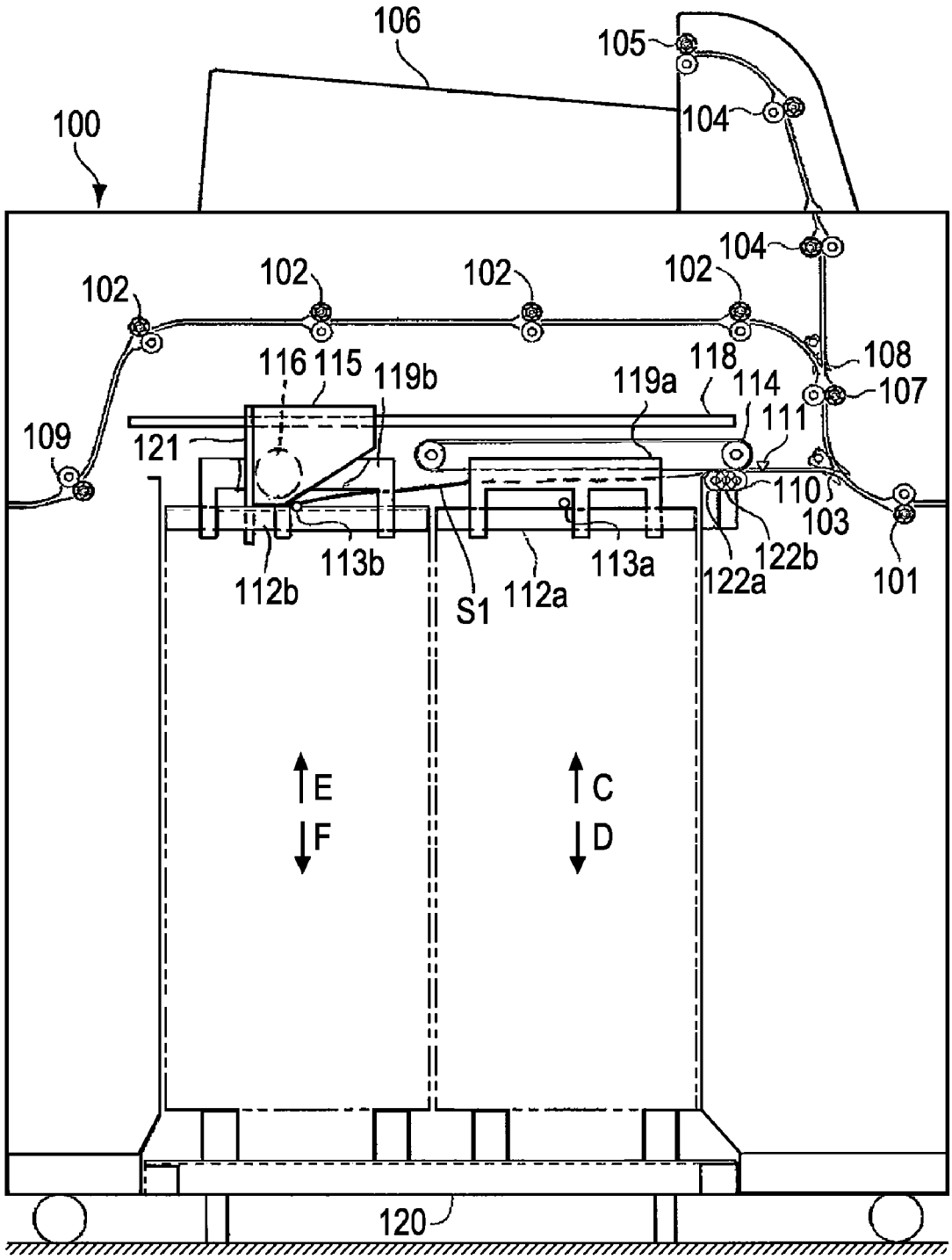
FIG. 12 shows a state where a sheet is going to be stacked over part of the second stacker tray and the entirety of the first stacker tray.

Referring to FIG. 12, an operation of stacking a sheet S over the entirety of the first stacker tray 112*a* and part of the second stacker tray 112*b* will be described.

If the sheet information indicates that the sheet S is to be stacked over the entirety of the first stacker tray 112*a* and part of the second stacker tray 112*b*, the stacker control portion 210 causes the sheet guiding unit 115 to stand by at a position above a halfway point of the second stacker tray 112*b*, the position matching the length of the sheet S, and the extension roller 122*a* to stand by at the upstream end of the discharging belt 114. In this case, the upstream end of the discharging belt 114 at which the extension roller 122*a* is in contact with the discharging belt 114 is defined as the sheet discharging position of the discharging portion. Thus, sheets can be stacked over the entirety of the first stacker tray 112*a* and part of the second stacker tray 112*b*, as desired by the user.

Further, the stacker control portion 210 causes the first and second stacker trays 112*a* and 112*b* to stand by at their home positions while causing the home position detection sensors 113*a* and 113*b* to detect the first and second stacker trays 112*a* and 112*b*.

As shown in FIG. 12, the sheet S1 delivered from the body 900A of the image forming apparatus 900 (FIG. 1) is discharged toward the first and second stacker trays 112*a* and 112*b* while the discharging belt 114, the driven roller 110, and the extension rollers 122*a* and 122*b* in combination nip the sheet S1 and rotate. During this operation, the sheet conveying speed produced by the discharging belt 114 is controlled as in the case shown in FIG. 11. Thus, the sheet S1 is stably delivered to the knurled belt 116 and is assuredly made to knock against the leading end stopper 121 with the aid of the knurled belt 116. As a result, even though the leading end of the sheet S1 is positioned above a halfway point of the second stacker tray 112*b*, tilting of the sheet S1 is corrected, whereby the leading ends of the sheet S is aligned with improved accuracy.

Subsequently, the pair of aligning plates 119*a* and 119*c* and the pair of aligning plates 119*b* and 119*d* align the sheet S in the width direction.

By repeating the above-described operation, the stacker 100 sequentially stacks sheets S1 over the first and second stacker trays 112*a* and 112*b* with high alignment accuracy. When the first and second stacker trays 112*a* and 112*b* become full of sheets, the first and second stacker trays 112*a* and 112*b* carrying the sheets thereon are placed on the dolly 120 and are ready to be carried outside.

Second Embodiment

Figure 13:
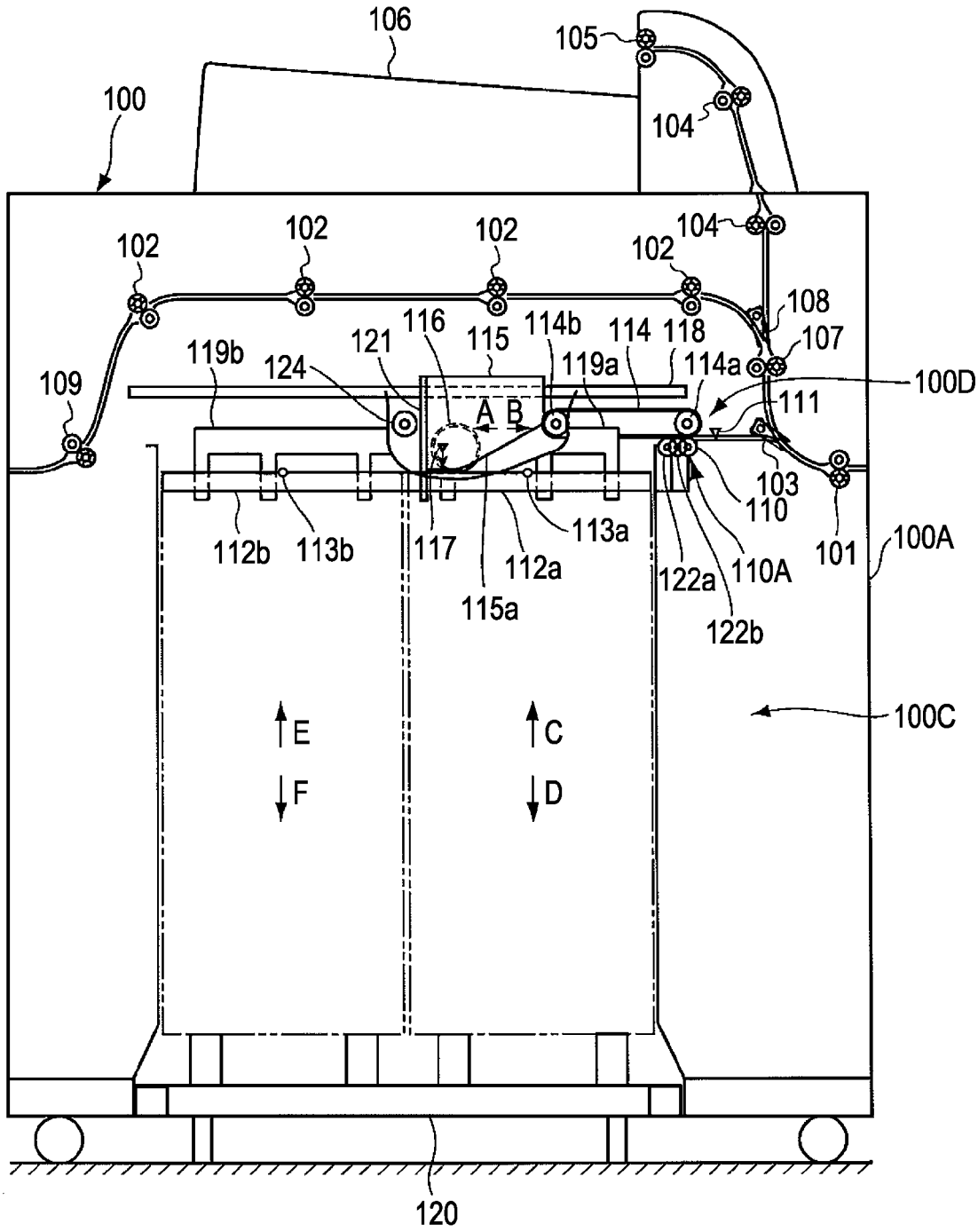
FIG. 13 schematically shows a stacker, as a sheet stacking apparatus, according to a second embodiment of the present invention, including a discharging belt of a short length.

While the extended path 130 of the stacker 100 in the first embodiment is configured to discharge sheets with the aid of the discharging belt 114 that is driven to rotate, a sheet discharging roller 124 may be provided on the downstream with respect to the discharging belt 114, like an extension path shown in FIG. 13. The discharging belt 114 of the stacker 100 according to a second embodiment shown in FIG. 13 is shorter than the discharging belt 114 shown in FIGS. 4, 7, and 11. Further, the sheet discharging roller 124 is provided near the upstream end of the second stacker tray 112*b*. The extension roller 122*a* is configured to be brought into contact with the sheet discharging roller 124. In this case, a point at which the sheet discharging roller 124 is in contact with the extension roller 122*a* is defined as the sheet discharging position of the discharging portion when sheets are discharged onto the second stacker tray 112*b*. Now, features of the stacker 100 according to the second embodiment will be described. Description of the components common to the stacker 100 according to the first embodiment will be omitted.

For improved sheet stacking accuracy, the discharging belt 114 shown in FIGS. 4, 7, and 11 is configured to reduce the speed of its rotation during a period after the timing sensor 111 detects the passage of a sheet until immediately before the trailing end of the sheet comes out of the nip between the discharging belt 114 and the extension roller 122*a*. In such a case, however, if a subsequent sheet is delivered to the discharging belt 114 while the speed of the discharging belt 114 is being reduced or while the speed of the discharging belt 114 is being increased so as to regain the original rotating speed, the subsequent sheet may slack or be jammed because the conveying speed produced by the pair of entrance rollers 101 is higher than that produce by the discharging belt 114. This means that the subsequent sheet cannot be delivered appropriately to the discharging belt 114 during reduction or increase of the rotating speed of the discharging belt 114. Therefore, the interval between a sheet that is being discharged and the subsequent sheet needs to be at least the same length as the discharging belt 114.

In contrast, the discharging belt 114 in the extension path shown in FIG. 13 continuously rotates at a sheet conveying speed the same as that produced by the pair of entrance rollers 101. Instead, the sheet discharging roller 124 is configured to be capable of reducing and increasing its rotating speed.

When a sheet is delivered toward the sheet discharging roller 124, the sheet discharging roller 124 receives the sheet from the discharging belt 114. At this time, the sheet discharging roller 124 conveys the sheet at a sheet conveying speed the same as that produced by the pair of entrance rollers 101. About the time when the trailing end of the sheet passes the discharging belt 114, the sheet discharging roller 124 reduces the speed of its rotation. The sheet is made to knock against the leading end stopper 121 of the sheet guiding unit 115, whereby the leading end of the sheet is aligned and the sheet is stacked onto the second stacker tray 112*b*. After the trailing end of the sheet passes the sheet discharging roller 124, the sheet discharging roller 124 regains the original sheet conveying speed.

As described above, since the extension path shown in FIG. 13 is configured such that the sheet conveying speed is reduced by the sheet discharging roller 124, the interval between the preceding sheet and the subsequent sheet can be shortened to the length from the downstream end of the discharging belt 114 to the sheet discharging roller 124.

Thus, the stacker 100 shown in FIG. 13 is capable of stacking sheets onto the second stacker tray 112*b* with reduced influence on the sheet conveying speed.

Further, in the stacker 100 shown in FIG. 13, the extension roller 122*a* may be configured to be in contact with the discharging belt 114 at any changeable position on the discharging belt 114 so that the sheet discharging position can be changed to a desired position suitable for sheet discharging onto the first stacker tray 112*a*. In short, the extension roller 122*a* may be configured to be in contact with the discharging belt 114 at any desired position on the discharging belt 114, whereby the sheet discharging position may be changed. In such a case, it is desirable that the discharging belt 114 is configured to reduce the speed of its rotation in discharging a sheet so that alignment accuracy in discharging a sheet can be improved.

The stacker 100 of the second embodiment includes one sheet discharging roller 124 and one discharging belt 114. The numbers of sheet discharging rollers and discharging belts are not limited. For example, the stacker 100 may include no sheet discharging rollers but a plurality of discharging belts. Also in such a case, the position of the extension roller 122*a* may be changeable so that the extension roller 122*a* can be in contact with any selected one of the discharging belts. In this manner, the sheet discharging position can be changed to a desired position suitable for sheet discharging onto a desired stacker tray. Alternatively, the stacker 100 may include no discharging belts but a plurality of sheet discharging rollers. Also in such a case, the position of the extension roller 122*a* may be changeable so that the extension roller 122*a* can be in contact with any selected one of the sheet discharging rollers. In this manner, the sheet discharging position can be changed to a desired position suitable for sheet discharging onto a desired stacker tray. The discharging belts or the sheet discharging rollers may be positioned not only above the first stacker tray 112*a* but also above the second stacker tray 112*b*, and the extension rollers 122*a* and 122*b* may be configured to be movable also above the second stacker tray 112*b*.

In FIG. 13, the first and second stacker trays 112*a* and 112*b* arranged side by side in the sheet discharging direction can be individually raised and lowered by the first-stacker-tray elevation motor 152*a* and the second-stacker-tray elevation motor 152*b* (see FIG. 2) in directions indicated by the arrows C and D and the arrows E and F.

The stacker 100 also includes the first redirecting member 103, which is driven by a solenoid (not shown) and directs a sheet conveyed into the stacker 100 to a stacking portion 100C or another sheet stacking unit, i.e., the top tray 106. In FIG. 13, if the sheet discharge destination is a sheet processing apparatus (a stacker apparatus, not shown) disposed on the downstream of the stacker 100, the second redirecting member 108 is driven by a solenoid (not shown) to turn to a position shown in solid lines.

The stacker 100 shown in FIG. 13 has a body 100A, in which a sheet conveying device 100D is provided. The sheet conveying device 100D includes the sheet guiding unit 115 that guides the sheet that is discharged from the pair of conveying rollers 110A, described separately below, toward the stacker trays 112*a* and 112*b*. The sheet guiding unit 115 includes the following: the knurled belt 116 rotating clockwise and having resilience with which the sheet is drawn in to a position above the stacker trays 112*a* and 112*b*, and the leading end stopper 121 serving as a stopper that determines the position of the sheet in the sheet discharging direction.

The sheet guiding unit 115 is configured such that the sheet that is discharged thereto is drawn by the knurled belt 116 into a position between the knurled belt 116 and the first stacker tray 112*a* (or the second stacker tray 112*b*) and then is made to knock against the leading end stopper 121. Thus, sheets can be stacked while the leading end of each sheet that is discharged is positioned with reference to the first or second stacker tray 112*a* or 112*b*.

The sheet guiding unit 115 is mounted on the slide shaft 118 slidably in directions indicated by the arrows A and B and is movable to a position matching the sheet size while being driven by a guiding unit driving motor (not shown). The sheet guiding unit 115 includes a frame having a tapered portion 115*a* so as to guide the sheet that is discharged thereto to the knurled belt 116.

The sheet surface detection sensor 117 is provided for maintaining a constant interval between the sheet guiding unit 115 and the top surface of the stack of sheets. A signal from the sheet surface detection sensor 117 is input to the stacker control portion 210 (see FIG. 2). In the second embodiment, the top surface of the stack of sheets is set to be at a level below the pair of conveying rollers 110A so that, in a case where some of the stacked sheets are curled upward, the leading end of a subsequent sheet is not stopped at the pair of conveying rollers 110A.

The home position detection sensors 113*a* and 113*b* detect the home positions of the first and second stacker trays 112*a* and 112*b* at the start of initial operation.

Sheet discharging is started in a state where the first and second stacker trays 112*a* and 112*b* are at their home positions on the basis of the detection by the home position detection sensors 113*a* and 113*b*, so that sheet stacking shown in FIG. 13 can be realized. When the first and second stacker trays 112*a* and 112*b* are at the home positions, respective sheet stacking surfaces of the first and second stacker trays 112*a* and 112*b* are positioned at the same level.

The sheet conveying device 100D includes the discharging belt 114. The discharging belt 114, serving as a sheet conveying member, is stretched between a driving roller 114*a* and a driven roller 114*b* and is rotatable counterclockwise with the aid of a discharging belt motor (not shown). With the discharging belt 114, sheets are discharged and stacked onto the first and second stacker trays 112*a* or 112*b*. The driven roller 110 is pressed against the discharging belt 114, whereby the driven roller 110 and the discharging belt 114 serve as the pair of conveying rollers 110A.

The sheet conveying device 100D also includes the sheet discharging roller 124 and the extension rollers 122*a* and 122*b*. The extension rollers 122*a* and 122*b* are movable in the sheet discharging direction. When sheets are discharged onto the second stacker tray 112*b*, the extension rollers 122*a* and 122*b* are moved by the extension roller drive unit 128 (see FIG. 2) to respective positions shown in FIG. 15, which will be described separately below.

Figure 15:
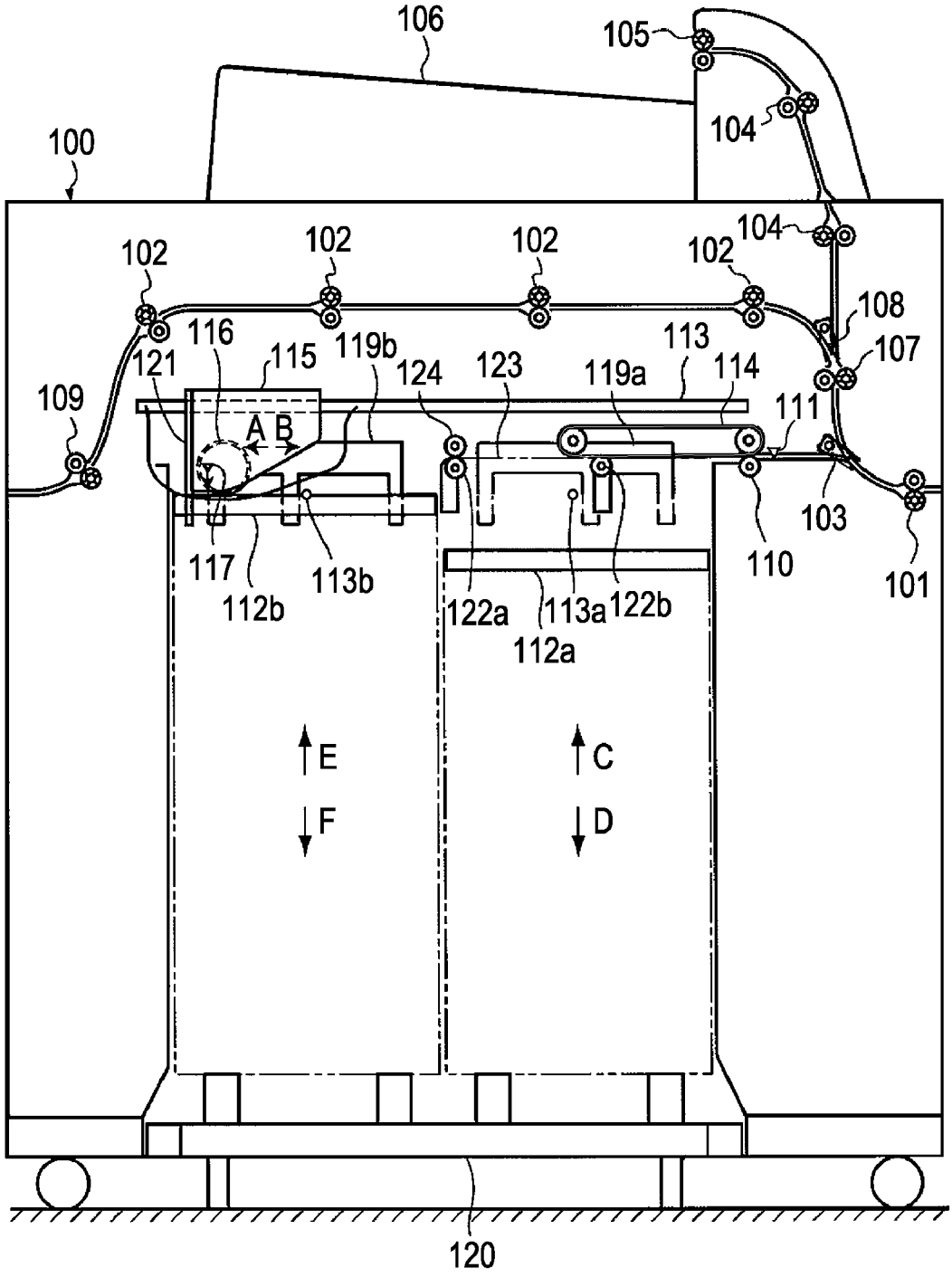
FIG. 15 is a diagram showing an operation of stacking a sheet onto the second stacker tray of the stacker according to the second embodiment.

The extension roller 122*a* is moved while drawing out the reel film 123, shown in FIG. 15 described separately below, which is a path-forming film member whose top surface forms the sheet conveying path over which each sheet passes. With the reel film 123, the sheet conveying path is extended. The extension roller 122*a* moved as described above is pressed against the sheet discharging roller 124 as shown in FIG. 15 described separately below, whereby the extension roller 122*a* and the sheet discharging roller 124 define the sheet discharging position of the discharging portion.

Figure 14A:
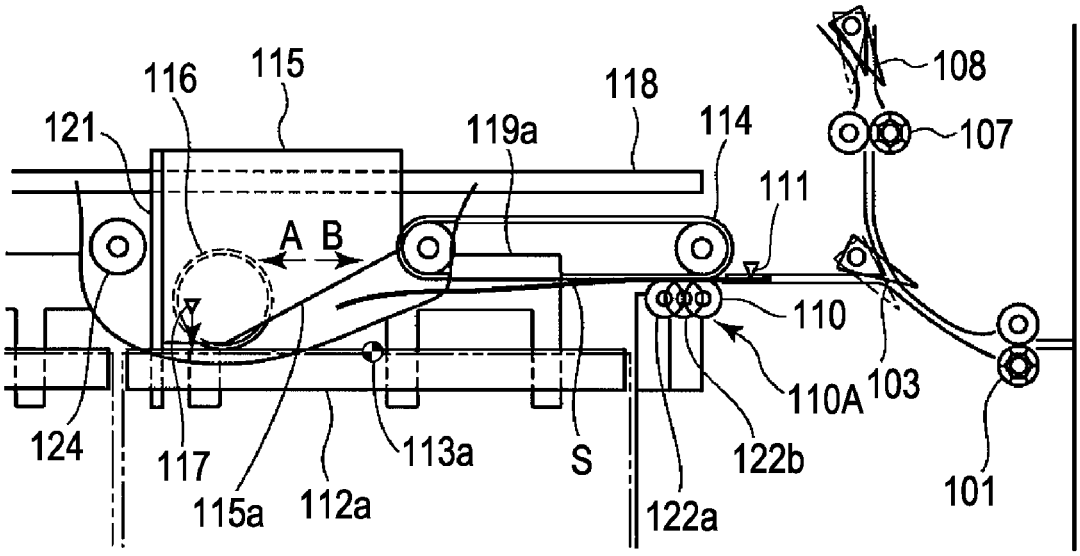
FIGS. 14A and 14B are diagrams each showing an operation of stacking a sheet onto the first stacker tray of the stacker according to the second embodiment.

Now, an operation of the stacker 100 in a case where sheets are stacked onto the first stacker tray 112*a* positioned on the upstream in the sheet discharging direction will be described. This operation is performed in step S103 of the flowchart shown in FIG. 20. In this operation, the stacker control portion 210 first causes the sheet guiding unit 115 to move to a predetermined sheet stacking position above the first stacker tray 112*a*, as shown in FIG. 14A, in accordance with the sheet size information contained in the sheet information sent to the stacker control portion 210 beforehand. In this state, the stacker 100 is ready for sheet stacking.

Next, a sheet S that has been discharged from the body 900A of the image forming apparatus 900 is conveyed through the pair of entrance rollers 101, the pair of conveying rollers 110A, and the discharging belt 114 and is brought into contact with the tapered portion 115*a* of the sheet guiding unit 115. With the guide of the tapered portion 115*a* toward the first stacker tray 112*a*, the leading end of the sheet S is led to the knurled belt 116.

On the other hand, when the timing sensor 111 disposed on the upstream with respect to the discharging belt 114 detects the passage of the leading end of the sheet S, the rotating speed of the discharging belt 114 is reduced, in response to the detection, before the trailing end of the sheet S is released from the discharging belt 114. In this manner, the sheet S can be conveyed stably to the knurled belt 116. The sheet discharging speed produced at this time is substantially the same as the conveying speed produced by the knurled belt 116.

Figure 14B:
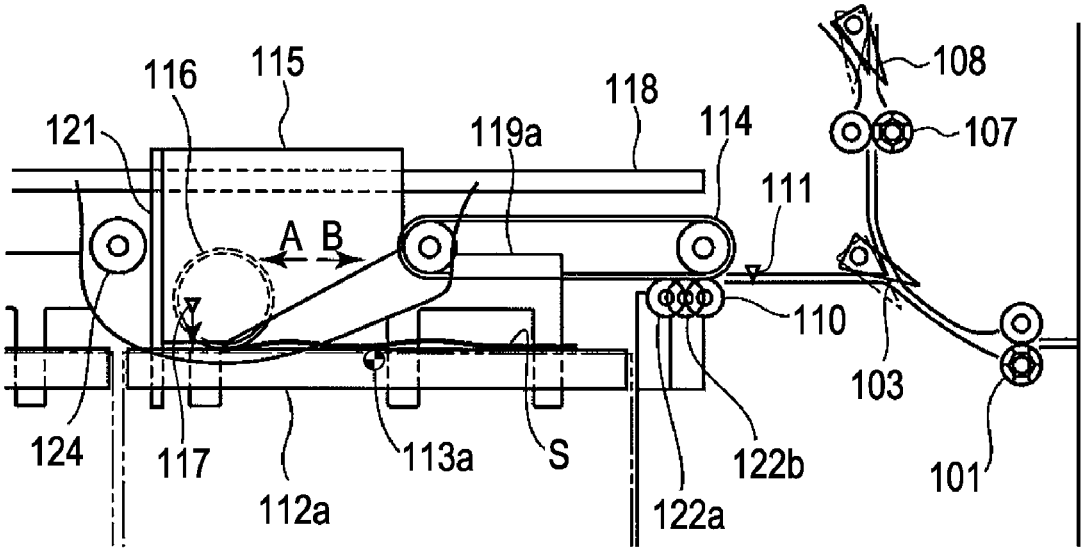

Subsequently, referring to FIG. 14B, the sheet S is assuredly made to knock against the leading end stopper 121 with the aid of the knurled belt 116, whereby tilting of the sheet S is corrected. Then, after widthwise displacement (displacement in lateral registration) of the sheet S is corrected with a jogging motion of the aligning plate 119*a* in the sheet width direction, the sheet S is stacked onto the first stacker tray 112*a* with high alignment accuracy. The rotating speed of the discharging belt 114 that has been reduced is increased after the sheet S is discharged, so that the same conveying speed as that produced by the pair of entrance rollers 101 is regained before a subsequent sheet is conveyed to the discharging belt 114.

By repeating such a sheet stacking sequence, sheets S are sequentially stacked onto the first stacker tray 112*a* with high alignment accuracy. During the sheet stacking sequence, the sheet surface detection sensor 117 continuously monitors the top surface of the stack of sheets. When the interval between the sheet guiding unit 115 and the top surface of the stack of sheets becomes smaller than the predetermined interval, the first-stacker-tray elevation motor 152*a* (see FIG. 2) is controlled to lower the first stacker tray 112*a* by a predetermined length so that a constant interval is maintained between the sheet guiding unit 115 and the top surface of the stack of sheets. Thus, a force with which each sheet is guided is maintained at a constant level and sheet stacking with improved accuracy can be realized.

Detection of the state where the first stacker tray 112*a* is full of sheets S is usually performed on the basis of the number of sheets S that have been discharged from the pair of conveying rollers 110A or by using a detector or the like that detects the height of the stack of sheets S on the first stacker tray 112*a*. When the first stacker tray 112*a* becomes full of sheets S, the first stacker tray 112*a* is automatically lowered to and secured on the dolly 120 shown in FIG. 18. In this state, the sheets are ready to be carried outside.

Now, an operation of the stacker 100 in a case where sheets are stacked onto the second stacker tray 112*b* positioned on the downstream in the sheet discharging direction will be described. This operation is performed in step S113 of the flowchart shown in FIG. 20. In the second embodiment, sheets are stacked onto the second stacker tray 112*b* if, for example, the first stacker tray 112*a* has no room for new sheets or if the size of sheets to be newly stacked is not the same size as that of the existing sheets on the first stacker tray 112*a*.

If the first stacker tray 112*a* has no room for new sheets or if the size of sheets to be newly stacked is not the same size as that of the existing sheets on the first stacker tray 112*a*, the stacker control portion 210 starts controlling the operation of stacking sheets onto the second stacker tray 112*b*.

First, referring to FIG. 15, the first and second stacker trays 112*a* and 112*b* are lowered by the first-stacker-tray elevation motor 152*a* and the second-stacker-tray elevation motor 152*b*, respectively, to positions at which the first and second stacker trays 112*a* and 112*b* allow the sheet guiding unit 115 to move. Then, the sheet guiding unit 115 is moved by a drive unit (not shown) in the arrow-A direction and is stopped at a sheet stacking position above the second stacker tray 112*b*. Subsequently, the second stacker tray 112*b* is raised by the second-stacker-tray elevation motor 152*b* to a position at which the home position detection sensor 113*b* can detect the second stacker tray 112*b*.

Next, the extension rollers 122*a* and 122*b* are moved leftward in FIG. 15 by the extension roller drive unit 128, serving as a moving unit, while the reel film 123 is drawn out of a case, whereby the sheet conveying path is extended. The sheet conveying path is extended so as to reach a position at which each sheet can be stably discharged onto the second stacker tray 112*b*, i.e., a position at which substantially the same positional relationship is established between the extension roller 122*a* and the first stacker tray 112*a* and between the extension roller 122*a* and the second stacker tray 112*b*. When the above-described sequences are completed and the state shown in FIG. 15 is established, the stacker 100 is ready for sheet stacking onto the second stacker tray 112*b*.

Then, a sheet S that has been discharged from the body 900A of the image forming apparatus 900 is conveyed through the pair of entrance rollers 101 and the pair of conveying rollers 110A, and is further conveyed by the discharging belt 114 over the reel film 123 that have been drawn out.

Figure 16A:
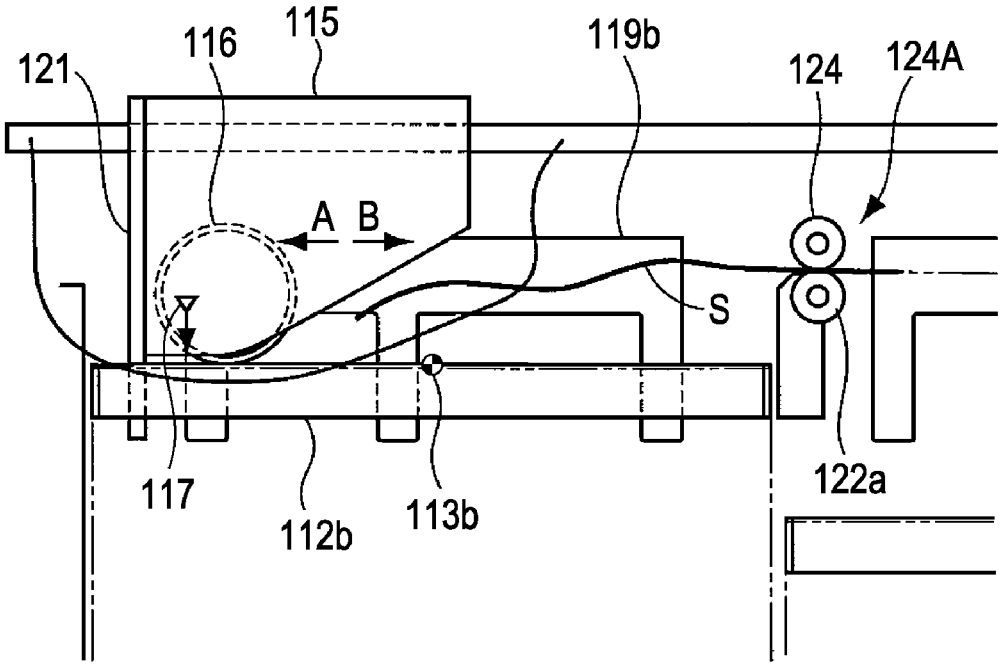
FIGS. 16A and 16B are other diagrams each showing the operation of stacking a sheet onto the second stacker tray of the stacker according to the second embodiment.

Subsequently, referring to FIG. 16A, the sheet S is conveyed toward the sheet guiding unit 115 through a pair of sheet discharging rollers (a sheet discharging portion) 124A constituted by the extension roller 122*a*, one of a pair of rotary members, and the sheet discharging roller 124, the other rotary member.

On the other hand, when the passage of the leading end of the sheet S is detected by the timing sensor 111, the rotating speed of the discharging belt 114 is reduced, in response to the detection, before the trailing end of the sheet S is released from the extension roller 122*a*. Thus, the sheet S can be stably conveyed to the knurled belt 116.

Figure 16B:
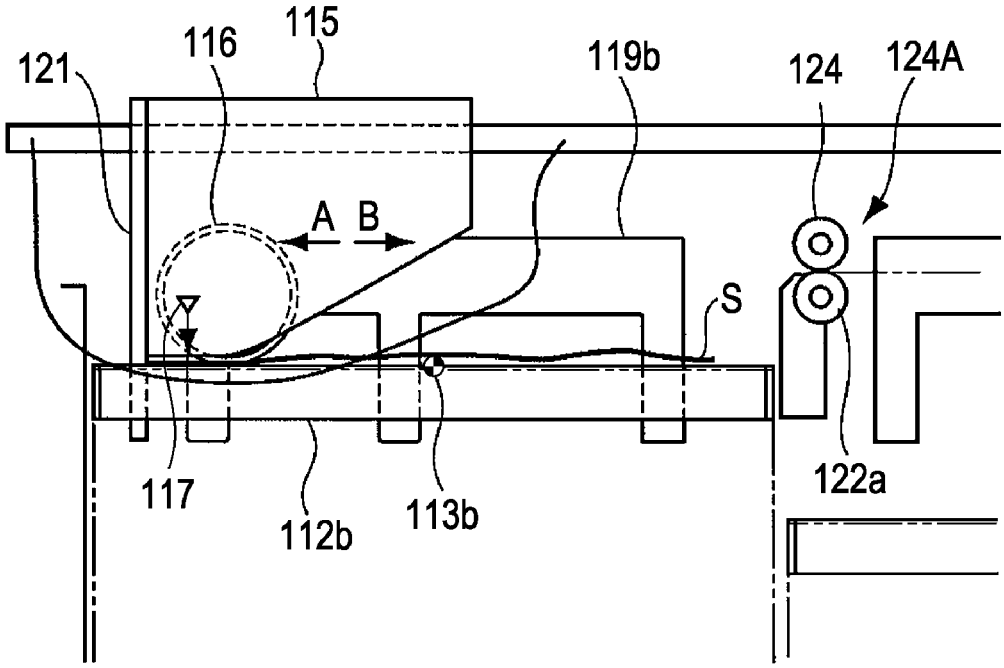

Next, referring to FIG. 16B, the sheet S is assuredly made to knock against the leading end stopper 121 with the aid of the knurled belt 116, whereby tilting of the sheet S is corrected. Then, after displacement in lateral registration of the sheet S is corrected with a jogging motion of the aligning plate 119*b* in the sheet width direction, the sheet S is stacked onto the second stacker tray 112*b* with high alignment accuracy. The rotating speed of the discharging belt 114 that has been reduced is increased after the sheet S is discharged, so that the same conveying speed as that produced by the pair of entrance rollers 101 is regained before a subsequent sheet is conveyed to the discharging belt 114.

By repeating such a sheet stacking sequence, sheets S are sequentially stacked onto the second stacker tray 112*b* with high alignment accuracy. During the sheet stacking sequence, the sheet surface detection sensor 117 continuously monitors the top surface of the stack of sheets. When the interval between the sheet guiding unit 115 and the top surface of the stack of sheets becomes smaller than the predetermined interval, the second-stacker-tray elevation motor 152*b* (see FIG. 2) is controlled to lower the second stacker tray 112*b* by a predetermined length so that a constant interval is maintained between the sheet guiding unit 115 and the top surface of the stack of sheets. Thus, a force with which a sheet is guided is maintained at a constant level and sheet stacking with improved accuracy can be realized.

Detection of the state where the second stacker tray 112*b* is full of sheets S is usually performed on the basis of the number of sheets S that have been discharged from the pair of conveying rollers 110A or by using a detector or the like that detects the height of the stack of sheets on the second stacker tray 112*b*. When the second stacker tray 112*b* is full of sheets S, the second stacker tray 112*b* is automatically lowered to and secured on the dolly 120. In this state, the sheets are ready to be carried outside.

Carrying Sheets from Stacker

Figure 18:
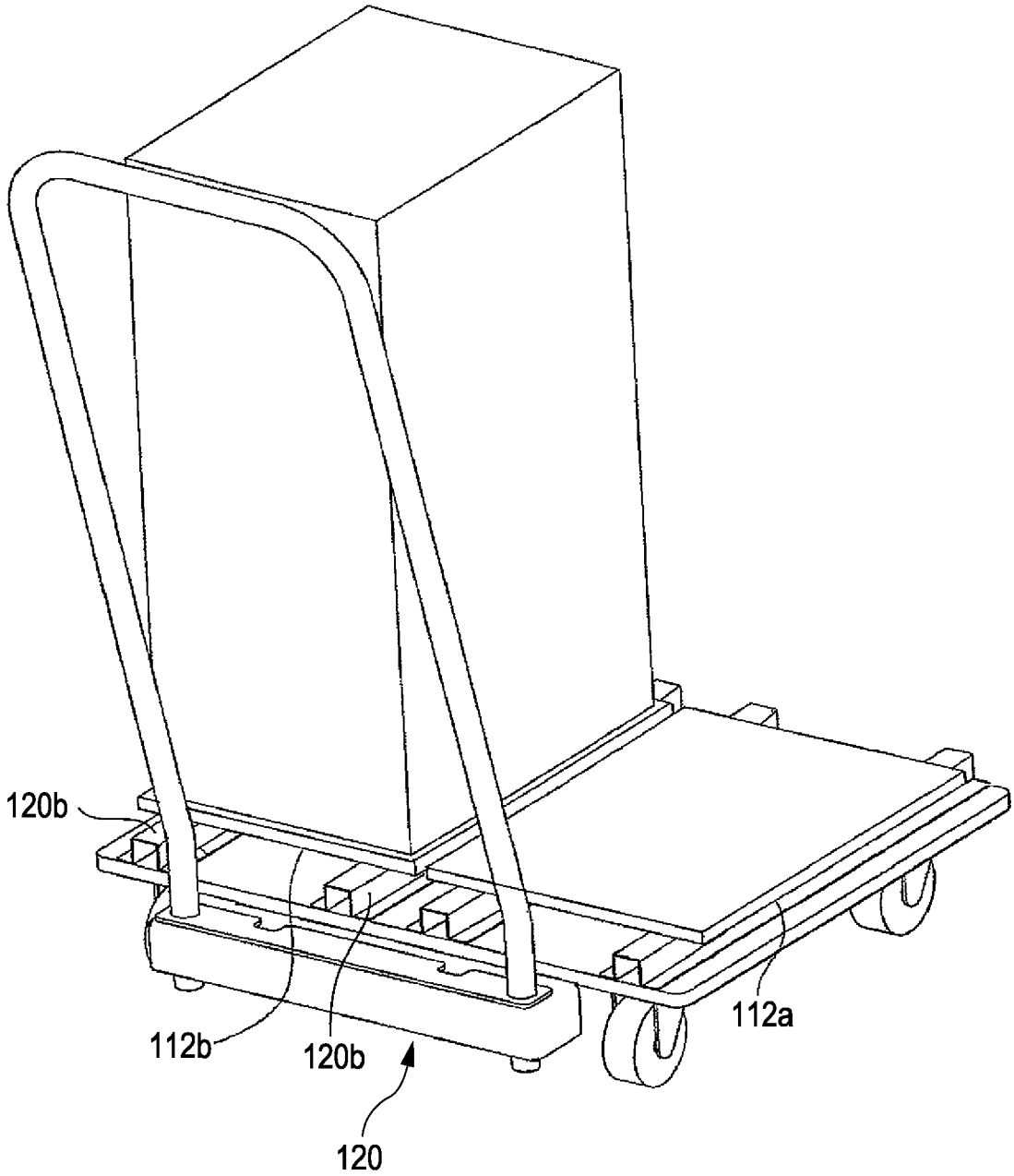
FIG. 18 shows a case where a stack of sheets on the second stacker tray is carried with the dolly.
Figure 19:
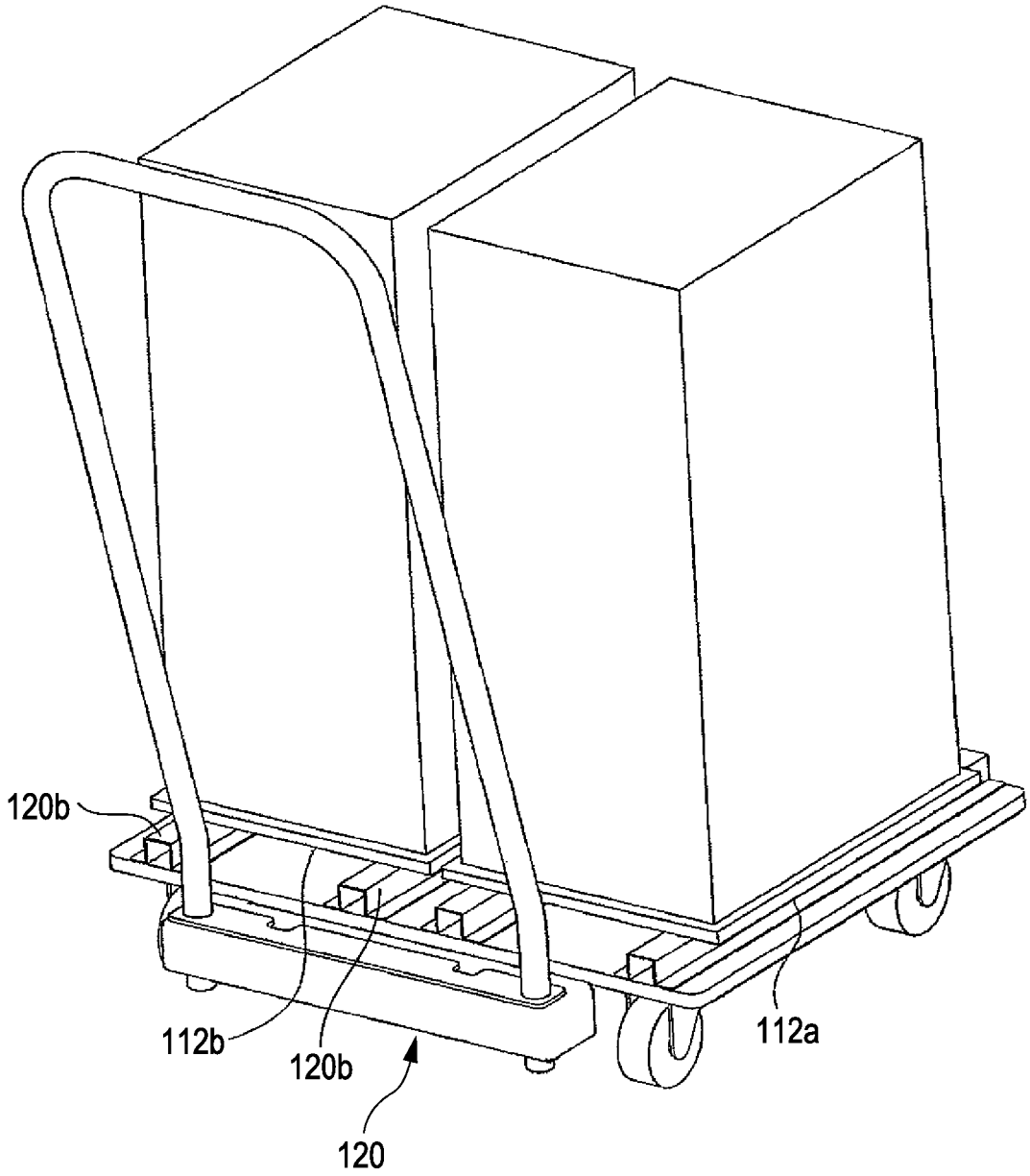
FIG. 19 shows a case where stacks of sheets on the first and second stacker trays are carried with the dolly.

In the first and second embodiments described above, after the first and second stacker trays 112*a* and 112*b* are lowered under the control of the stacker control portion 210 to the positions at which they are made ready to be carried outside, the first and second stacker trays 112*a* and 112*b* are secured to the dolly 120 with securing members, such as pins or depressions, provided to the dolly 120. FIG. 17 shows a state where the first stacker tray 112*a* is full of sheets. FIG. 18 shows a state where the second stacker tray 112*b* is full of sheets. FIG. 19 shows a state where both the first and second stacker trays 112*a* and 112*b* are full of sheets. In the states shown in FIGS. 17 and 18, it is not necessary to place on the dolly 120 the stacker tray having no sheets thereon.

The dolly 120 has four casters 146. To move the dolly 120, the user can hold a handle 147. Thus, a large stack of sheets can be easily carried at a time.

However, it is not necessary to use the dolly 120 in carrying sheets. The user may carry sheets by directly holding them. Even in the latter case, the user can easily carry the stack of sheets without disturbing the stack because the stacker according to the embodiments of the present invention is configured such that sheets can be stacked at a desired position over the stacker trays by changing the sheet discharging position of the discharging portion.

In the first and second embodiments described above, the home position detection sensors 113*a* and 113*b* are used to determine the initial positions (home positions) of the first and second stacker trays 112*a* and 112*b*. Instead of the home position detection sensors 113*a* and 113*b*, the sheet surface detection sensor 117 may be used to determine the initial positions (home positions) of the first and second stacker trays 112*a* and 112*b*.

In the above description, sheets are stacked onto the first stacker tray 112*a* and the second stacker tray 112*b* in that order. However, the order of the stacker trays to be used is not limited. Moreover, the two stacker trays may have different lengths. In addition, three or more stacker trays may be provided (as long as they are arranged side by side in the sheet discharging direction).

In the above description, the discharging belt 114 and the sheet discharging roller 124 serve as driving members and the extension rollers 122*a* and 122*b* serve as driven members. This relationship between the driving members and the driven members may be reversed.

In the above description, the discharging belt 114 is configured to reduce its rotating speed so that the impact of the sheet on the leading end stopper 121 can be reduced, whereby alignment accuracy of the leading end of each sheet is improved. However, depending on the sheet conveying speed produced by the pair of entrance rollers 101, the discharging belt 114 is not necessarily caused to reduce its rotating speed.

As described above, the stacker 100 serving as the sheet stacking apparatus according to the embodiments of the present invention includes the following as major elements: a sheet discharging portion through which sheets are discharged, including the discharging belt 114, the sheet discharging roller 124, and the extension rollers 122*a* and 122*b*; and a plurality of sheet stacking units including the first and second stacker trays 112*a* and 112*b* arranged side by side in the sheet discharging direction and onto which sheets are stacked after being discharged through discharging rotary members, i.e., the discharging belt 114 and the sheet discharging roller 124, and through movable rotary members, i.e., the extension rollers 122*a* and 122*b*.

The stacker 100 with such a configuration has a sheet discharging portion constituted by the discharging belt 114, the sheet discharging roller 124, and the extension roller 122*a* configured to be brought into contact with either of the discharging belt 114 and the sheet discharging roller 124. Further, the sheet discharging position of such a sheet discharging portion is changeable depending on whether the extension roller 122*a* is brought into contact with the discharging belt 114 or the sheet discharging roller 124. This means that, in the stacker 100, the position of the extension roller 122*a* can be changed in accordance with the sheet length, whereby the sheet discharging position can be changed as desired. Therefore, sheets can be stacked at a desired position on the first and second stacker trays 112*a* and 112*b* so that the user can easily carry the stacked sheets. Moreover, in the stacker 100, sheet stacking onto the second stacker tray 112*b* can be realized with high alignment accuracy by reducing the rotating speed of the sheet discharging roller 124.

In the stacker 100, sheets can be discharged and stacked while a constant interval between the sheet stacking surface and the extension roller 122*a* (the sheet discharging position of the discharging portion) is maintained. Therefore, in the stacker 100, a large number of sheets can be rapidly and stably stacked onto the first and second stacker trays 112*a* and 112*b*. Moreover, since the large number of sheets are stacked with high alignment accuracy, the stack of sheets can be assuredly carried with the dolly 120 to a desired position without disturbing the alignment of the stack.

The stacker 100 includes the reel film 123 having a belt-like shape that can be drawn in and out on the upstream with respect to the extension rollers 122*a* and 122*b* in the sheet discharging direction, along with the movement of the extension rollers 122*a* and 122*b*. The reel film 123 in the state of being drawn out supports the sheet, below the discharging belt 114. Therefore, in the stacker 100, sheets can be discharged onto the first and second stacker trays 112*a* and 112*b* with no slack, which may trigger jamming, between the extension roller 122*a* and the extension roller 122*b*.

The stacker 100 also includes the leading end stopper 121 serving as a stopper. The leading end stopper 121, disposed on the downstream with respect to the discharging belt 114 in the sheet discharging direction, is movable in the sheet discharging direction and can stop the leading end of a sheet that is discharged through the nip between the discharging belt 114 and the extension roller 122*a* or between the sheet discharging roller 124 and the extension roller 122*a*. Therefore, in the stacker 100, even if the sheet discharging position is changed, sheets can be stacked onto the first and second stacker trays 112*a* and 112*b* with high alignment accuracy by setting the position of the leading end stopper 121 in accordance with the sheet discharging position and the sheet length.

Third Embodiment

Figure 21:
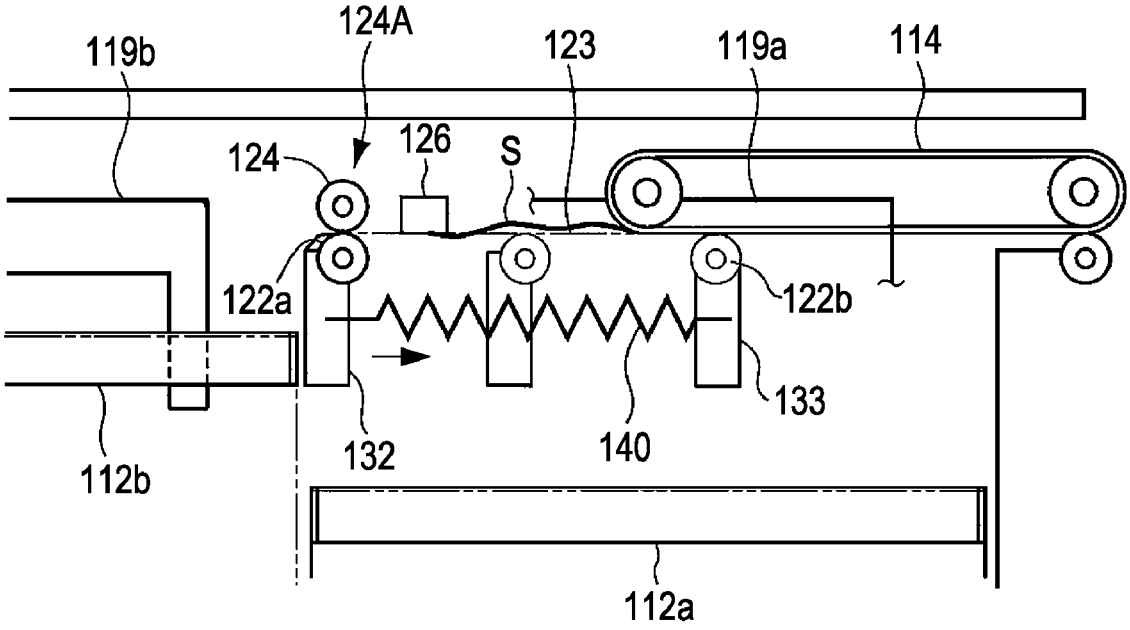
FIG. 21 shows a state where a sheet is going to be stacked onto the second stacker tray of a stacker according to a third embodiment of the present invention.

FIG. 21 shows relevant parts of the stacker 100 according to a third embodiment. The stacker 100 has on its top the top tray 106 on which sheets that are discharged from the body 900A of the image forming apparatus 900 are stacked. The stacker 100 also includes a stacking portion 100C as a sheet stacking portion. The stacking portion 100C includes two stacker trays (first and second stacker trays) 112*a* and 112*b* arranged side by side in the sheet discharging direction so that a large number of sheets can be stacked without increasing the size of the stacker 100. Now, features of the stacker 100 according to the third embodiment will be described. Description of the components common to the stacker 100 according to the second embodiment will be omitted.

To stack a sheet S onto the second stacker tray 112*b*, the extension rollers 122*a* and 122*b* are moved by the extension roller drive unit 128 having a motor, a belt, and so forth (not shown) in the sheet discharging direction, as described above. In FIG. 21, the extension rollers 122*a* and 122*b* are held by the sliders 132 and 133, respectively. The extension roller drive unit 128 moves the extension rollers 122*a* and 122*b* together with the sliders 132 and 133.

The extension roller drive unit 128 moves the extension roller 122*a* to a first position where the extension roller 122*a* is pressed against the sheet discharging roller 124 while forming a nip therebetween, and holds the extension roller 122*a* at the first position. In short, to stack the sheet S onto the second stacker tray 112*b*, the extension roller 122*a* is moved to the first position and is held at the first position by the extension roller drive unit 128 serving as a moving unit.

In FIG. 21, the tension spring 140 serves as an urging member that urges the extension roller 122*a* in a direction opposite to the sheet discharging direction (hereinafter referred to as a counter-sheet-discharging direction). The tension spring 140 is connected at its ends to the sliders 132 and 133, respectively.

In the third embodiment, the extension rollers 122*a* and 122*b* are moved in such a manner that, after the slider 133 reaches a predetermined position, only the slider 132 is moved. This means that the extension roller 122*a* (the slider 132) is moved by the extension roller drive unit 128 to the first position, at which the extension roller 122*a* and the sheet discharging roller 124 form a nip therebetween, while resisting the force applied by the tension spring 140.

After moving to the first position as described above, the extension roller 122*a* stops with the aid of a holding force applied by the extension roller drive unit 128. Further, since a current is being applied to the extension roller drive unit 128 while sheets are stacked onto the second stacker tray 112*b*, the extension roller 122*a* can be held at the first position while resisting the urging force applied by the tension spring 140.

On the other hand, if the stacker 100 stops because of sheet jamming or the like, the current supplied to the extension roller drive unit 128 is stopped. Accordingly, the extension roller drive unit 128 stops and releases the holding of the extension roller 122*a*. Consequently, the extension roller 122*a* is only subjected to the urging force of the tension spring 140 in the counter-sheet-discharging direction.

Therefore, the extension roller 122*a* moves away from the sheet discharging roller 124 to a second position at which the tension spring 140 loses its urging force in the counter-sheet-discharging direction. In the third embodiment, the static position (the second position) of the extension roller 122*a* resides out of the detectable range of the jammed sheet detection sensor 126 serving as a sheet detecting unit that detects a sheet for the purpose of detecting, for example, the timing for discharging the sheet. Thus, in operations performed after the jam is cleared, the jammed sheet detection sensor 126 can be prevented from misdetecting the reel film 123 as a jammed sheet.

In the case where the stacker 100 stops, since the extension roller 122*a* is automatically moved in the counter-sheet-discharging direction away from the sheet discharging roller 124 as described above, the sheet conveying path formed by the reel film 123 is contracted. As a result, it becomes easy to remove the sheet jammed between the sheet discharging roller 124 and the reel film 123.

Figure 22:
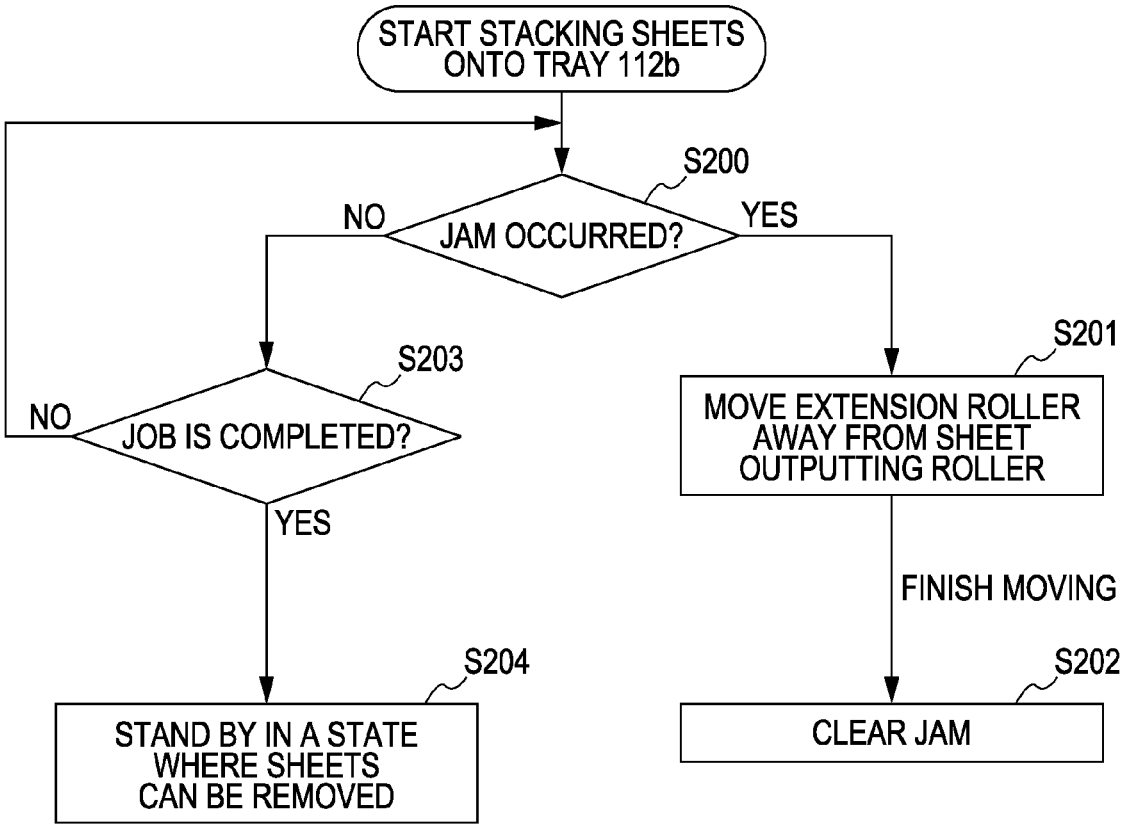
FIG. 22 is a flowchart for describing an operation of clearing a jam occurring during sheet stacking onto the second stacker tray of the stacker according to the third embodiment.

Now, an operation of clearing the jam occurring during sheet stacking onto the second stacker tray 112*b* of the stacker 100 having the above-described configuration will be described with reference to a flowchart shown in FIG. 22.

If a sensor (not shown) detects the occurrence of a jam (YES in step S200) after sheet stacking onto the second stacker tray 112*b* is started, the current supplied to the extension roller drive unit 128 is stopped and the extension roller drive unit 128 stops. Accordingly, the extension roller 122*a* is only subjected to the urging force of the tension spring 140 in the counter-sheet-discharging direction, and therefore the extension roller 122*a* is moved from the first position shown in solid lines to the second position shown in broken lines in FIG. 21, away from the sheet discharging roller 124 (step S201).

With the automatic movement of the extension roller 122*a* in the counter-sheet-discharging direction away from the sheet discharging roller 124 at the time when the stacker 100 stops, the sheet conveying path formed by the reel film 123 is contracted. After the movement of the extension roller 122*a* away from the sheet discharging roller 124 is finished, clearing of the jam is performed (step S202).

If no jam occurs (NO in step S201), sheets are continued to be stacked onto the second stacker tray 112*b* unless the job is completed (NO in step S203). When the job is completed (YES in step S203), the second stacker tray 112*b* is lowered so as to stand by in a state where the stacked sheets can be removed (step S204).

Then, after the sheet conveying path formed by the reel film 123 is contracted by moving the extension roller 122*a* away from the sheet discharging roller 124, the discharging belt 114, disposed on the upstream with respect to the sheet discharging roller 124, is rotated with a knob (not shown). In this manner, the sheet jammed between the sheet discharging roller 124 and the reel film 123 can be removed easily.

As described above, by moving the extension roller 122*a* away from the sheet discharging roller 124 and contracting the sheet conveying path formed by the reel film 123 while the stacker 100 is stopped, the sheet jammed on the reel film 123 can be removed easily.

To summarize, when a jam occurs between the discharging belt 114 and the pair of sheet discharging rollers 124A, the extension roller 122*a* can be retracted to a position away from the sheet discharging roller 124 with the aid of the tension spring 140, serving as a retracting member. Therefore, even in a case where the pair of sheet discharging rollers 124A and the discharging belt 114 are driven by different sources, the jammed sheet can be removed easily by rotating the discharging belt 114 using the knob (not shown).

In the third embodiment, the extension roller 122*a* is moved by the extension roller drive unit 128. As an alternative, the sheet discharging roller 124 may be configured to move toward and away from the extension roller 122*a*. As another alternative, the discharging belt 114 and the extension roller 122*a* may constitute a sheet discharging portion, with the extension roller 122*a* being movable toward and away from the discharging belt 114.

In the third embodiment, the urging force of the tension spring 140 is applied to the extension roller 122*a* in the counter-sheet-discharging direction. Alternatively, the urging force of the tension spring 140 may be applied to the extension roller 122*a* in the sheet conveying direction. In the latter case, the extension roller 122*a* is moved to the first position while the tension spring 140 is contracted. In the third embodiment, a spring is used as the urging member (a retracting member) that urges the extension roller 122*a*. The urging member may be of any other material such as rubber or magnet, as long as it can apply an urging force to the extension roller 122*a*.

While the above description concerns the case where, if a sheet is jammed, the extension roller 122*a* is moved (retracted) by using an urging member, the present invention is not limited thereto. For example, the extension roller 122*a* may be manually moved in the counter-sheet-discharging direction away from the sheet discharging roller 124.

Fourth Embodiment

Now, a fourth embodiment of the present invention in which the extension roller 122*a* is manually moved in the counter-sheet-discharging direction will be described.

Figure 23:
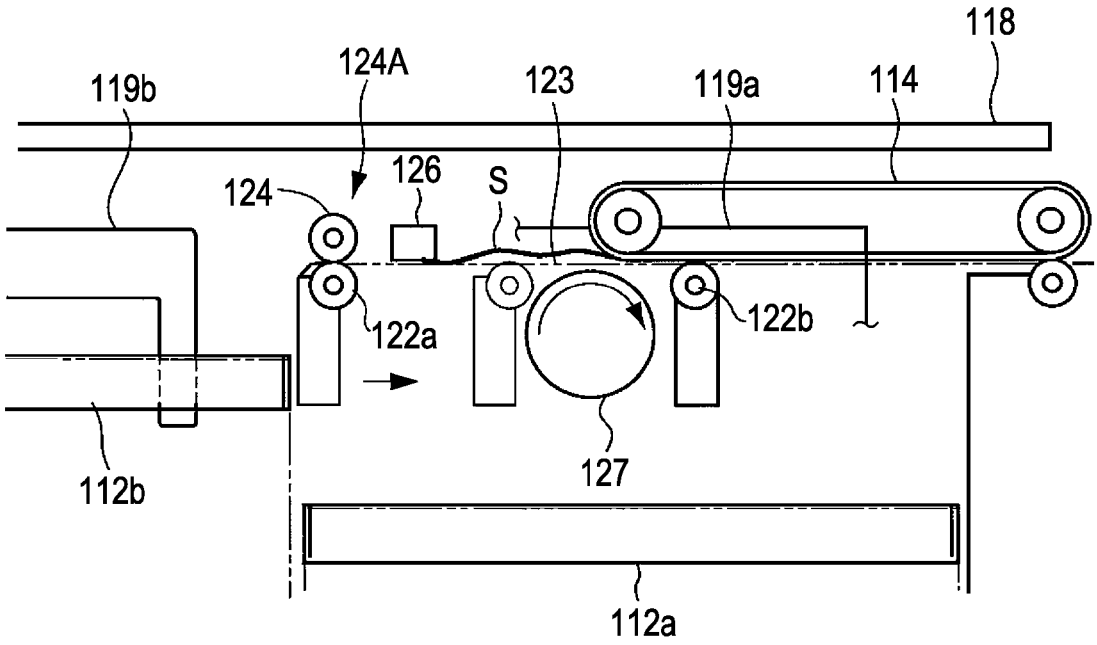
FIG. 23 shows a state where a sheet is going to be stacked onto the second stacker tray of a stacker, as a sheet stacking apparatus, according to a fourth embodiment of the present invention.
Figure 24:
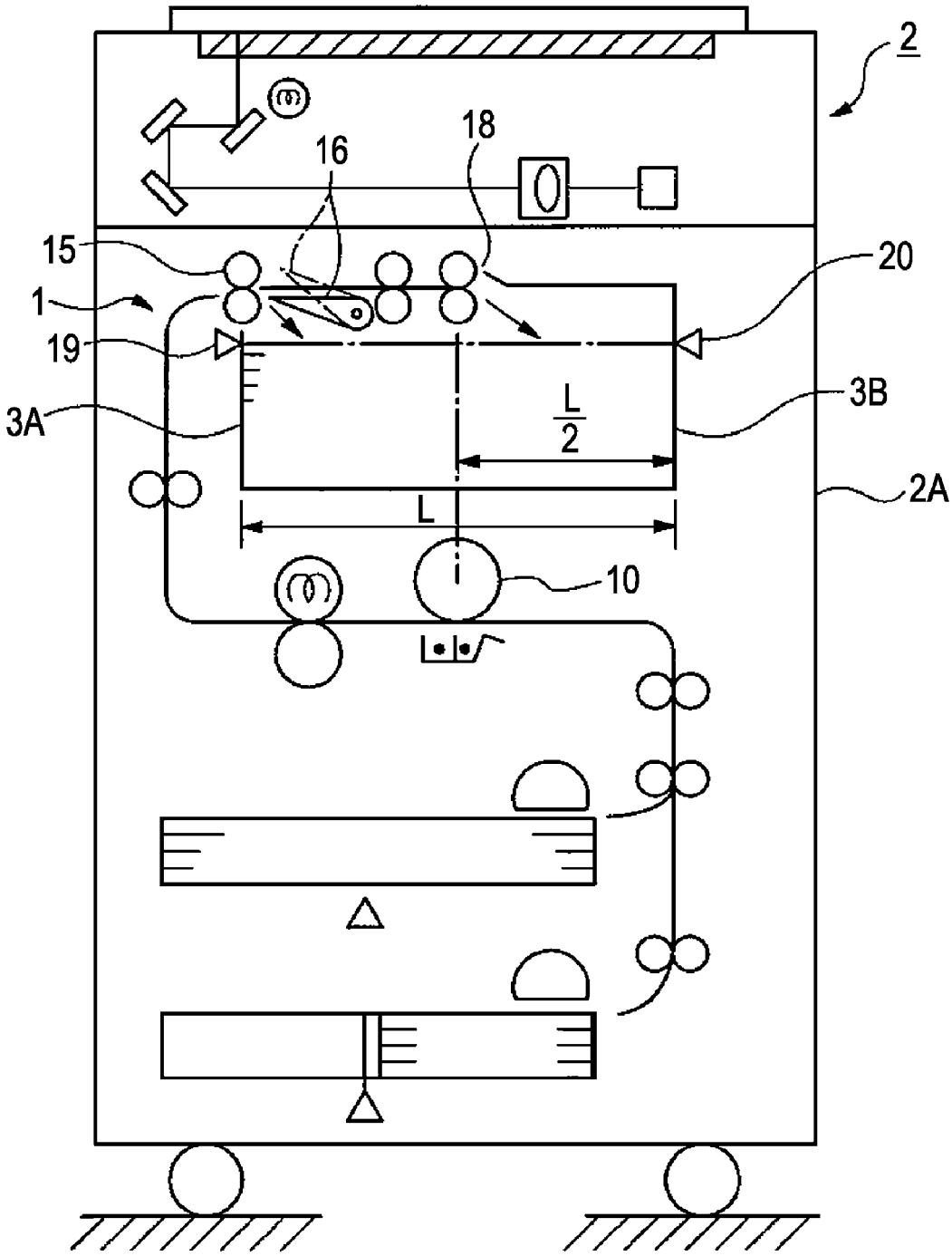
FIG. 24 is a cross-sectional view of a known stacker, as a sheet stacking apparatus, taken in the sheet conveying direction.

FIG. 23 shows relevant parts of the stacker 100 (a sheet stacking apparatus) according to the fourth embodiment in a state where sheets are to be stacked on the second stacker tray 112*b*. In FIG. 23, reference numerals the same as those used in FIG. 21 denote components the same as or equivalent to those shown in FIG. 21. Additionally, in the fourth embodiment, since no urging member (tension spring 140) that urges the extension roller 122*a* is provided, the extension roller 122*a* remains being pressed against the sheet discharging roller 124 even if the stacker 100 stops.

In FIG. 23, a roller moving knob 127 is used to manually move the extension roller 122*a* away from the sheet discharging roller 124 to the outside of the detectable range of the jammed sheet detection sensor 126. If the stacker 100 stops in the fourth embodiment, the extension roller 122*a* can be moved in the counter-sheet-discharging direction to the second position by rotating the roller moving knob 127 in a predetermined direction. In short, if the stacker 100 stops, the extension roller 122*a* can be manually moved (retracted) from the first position to the second position by using the roller moving knob 127 serving as a retracting member.

As described above, if the stacker 100 stops, the sheet conveying path formed by the reel film 123 can be contracted by manually moving with the roller moving knob 127 the extension roller 122*a* in the counter-sheet-discharging direction away from the sheet discharging roller 124. In other words, even in a case where the pair of sheet discharging rollers 124A and the discharging belt 114 are driven by different sources, the jammed sheet can be removed easily by rotating the discharging belt 114 using a knob (not shown).

In the fourth embodiment, the extension roller 122*a* is moved by using the roller moving knob 127. Alternatively, the sheet discharging roller 124 may be configured to be moved by rotating a knob. Moreover, in the forth embodiment, the extension roller 122*a* is moved in the counter-sheet-discharging direction in removing the jammed sheet. Alternatively, the extension roller 122*a* may be moved in the sheet discharging direction in removing the jammed sheet, as long as the extension roller 122*a* is configured to be movable in the sheet discharging direction.

While the first to fourth embodiments described above concern an exemplary case where the sheet conveying path is extended by using the extension rollers 122*a* and 122*b* and the discharging belt 114 in combination, the present invention is not limited thereto.

Specifically, it is only necessary that sheets can be conveyed to one of the stacker trays, which are arranged side by side in the sheet discharging direction, positioned on the downstream in the sheet discharging direction, and that the sheet conveying speed can be reduced during the sheet discharging operation. For example, conveyance of each sheet may be performed by chucking the sheet with a sheet conveying member such as an electrostatic chucking belt or an air chucking belt.

While some of the embodiments concerns the case where the tension spring 140 is connected at its ends to a central positions of the sliders 132 and 133, respectively, as shown in FIG. 21, the present invention is not limited thereto. For example, the tension spring 140 may be connected at its ends to the top ends of the sliders 132 and 133, respectively, as shown in FIG. 10. In FIG. 10, reference numerals the same as those used in FIG. 21 denote components the same as or equivalent to those shown in FIG. 21.

According to the embodiments of the present invention, if a sheet is jammed between a sheet conveying portion and a pair of rotary members that discharge a sheet toward a sheet stacking portion, one of the pair of rotary members can be retracted by using a retracting member to a position away from the other rotary member. Thus, even in a case where the pair of rotary members and the sheet conveying portion are driven by different sources, the jammed sheet can be removed easily.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-300599 filed Nov. 20, 2007 and No. 2007-300601 filed Nov. 20, 2007, which are hereby incorporated by reference herein in their entirety.

What is claimed is:

1. A sheet stacking apparatus comprising:

a plurality of sheet stacking units including at least a first sheet stacking unit and a second sheet stacking unit on which a sheet is stacked;

a sheet discharging portion configured to discharge the sheet on one of the plurality of sheet stacking units selectively, the sheet discharging portion including:

a plurality of discharging rotary members including at least a first discharging rotary member and a second discharging rotary member arranged in a sheet discharging direction and a movable rotary member, movable along the sheet discharging direction to selectively, form a nip with the first discharging rotary member to nip and discharge the sheet to the first sheet stacking unit and form a nip with the second discharging rotary member to nip and discharge the sheet to the second sheet stacking unit; and a controller which controls the movable rotary member so that the position of the movable rotary member is changed along the sheet discharging direction to a position of the selected first or second discharging rotary member to discharge the sheet to the corresponding first or second sheet stacking unit.

2. The sheet stacking apparatus according to claim 1, wherein at least one of the plurality of discharging rotary members has a discharging belt, along which the position of the movable rotary member is changed.

3. The sheet stacking apparatus according to claim 1, further comprising:

an extendable member which is provided upstream of the movable rotary member in the sheet discharging direction, the extendable member capable of being extended along with the movement of the movable rotary member, wherein when the extendable member is in a state of being extended, the extendable member supports the sheet discharging from the sheet discharging portion.

4. The sheet stacking apparatus according to claim 1, further comprising:

a stopper, disposed downstream of the sheet discharging portion in the sheet discharging direction, configured to be movable in the sheet discharging direction and to stop the leading end of the sheet that is discharged from the sheet discharging portion.

5. The sheet stacking apparatus according to claim 1, wherein the movable rotary member is a driven rotary member.

6. The sheet stacking apparatus according to claim 1, further comprising:

a moving unit configured to move the movable rotary member to a first position where the movable rotary member forms the nip with one of the plurality of discharging rotary members; and a retracting member configured to cause, when driving of the moving unit is stopped, the movable rotary member to retract from the first position to a second position away from the one of the plurality of discharging rotary members.

7. An image forming apparatus comprising:

an image forming portion configured to form an image on a sheet; and the sheet stacking apparatus according to claim 1 in which the sheet having the image formed thereon by the image forming portion is stacked.

* * * * *